US009993377B2

(12) United States Patent
Clenet

(10) Patent No.: US 9,993,377 B2
(45) Date of Patent: Jun. 12, 2018

(54) ARTICULATING BED WITH FLEXIBLE MATTRESS SUPPORT

(71) Applicant: Ergomotion, Inc., Santa Barbara, CA (US)

(72) Inventor: Alain Clenet, Santa Ynez, CA (US)

(73) Assignee: Ergomotion, Inc., Santa Barbara, CA (US)

( * ) Notice: Subject to any disclaimer, the term of this patent is extended or adjusted under 35 U.S.C. 154(b) by 565 days.

(21) Appl. No.: 14/569,683

(22) Filed: Dec. 13, 2014

(65) Prior Publication Data

US 2015/0121624 A1 May 7, 2015

Related U.S. Application Data

(63) Continuation-in-part of application No. 13/946,970, filed on Jul. 19, 2013, now Pat. No. 8,910,328.

(51) Int. Cl.

| | |
|---|---|
| ***A61G 7/015*** | (2006.01) |
| ***A61G 7/018*** | (2006.01) |
| *A61G 7/002* | (2006.01) |

(52) U.S. Cl.

CPC ..... *A61G 7/015* (2013.01); *A61G 7/018* (2013.01); *A61G 7/002* (2013.01)

(58) Field of Classification Search

CPC ..... A47C 20/04; A47C 20/041; A61G 7/002; A61G 7/005; A61G 7/012; A61G 7/015; A61G 7/018; A61G 13/02; A61G 13/04; A61G 13/06; A61G 13/08

USPC ..... 5/600, 610, 611, 613, 616–618

See application file for complete search history.

(56) References Cited

U.S. PATENT DOCUMENTS

| | | | | |
|---|---|---|---|---|
| 5,579,550 | A * | 12/1996 | Bathrick | A47C 19/005 5/184 |
| 6,101,647 | A * | 8/2000 | Stroud | A47C 20/041 5/613 |
| 6,951,037 | B2 * | 10/2005 | Weinman | A47C 20/041 5/200.1 |
| 7,000,269 | B2 * | 2/2006 | Borda | A47C 19/04 5/181 |
| 7,036,165 | B2 * | 5/2006 | Weinman | A61G 7/015 5/617 |

(Continued)

FOREIGN PATENT DOCUMENTS

| | | |
|---|---|---|
| GB | 2230948 A | 11/1990 |

*Primary Examiner* — Robert G Santos
(74) *Attorney, Agent, or Firm* — Felix L. Fischer

(57) ABSTRACT

An articulating bed incorporating a frame having side frame members and a rigid cross frame member extending between the side frame members employs a flexible support member secured to the rigid cross frame member. Support arms engage an upper body portion of the flexible support member with lubricious support and are rotatable through a range of motion from an aligned position with the side frame members to a fully elevated position angularly supporting the upper body portion in a raised position. A leg portion adjustment member engages the flexible support member at a knee position intermediate a thigh portion and a leg portion of the flexible support member. The leg portion adjustment member is rotatable through a range of motion from an aligned position with the side frame members to a fully elevated position placing the knee position at an elevated location with angular positioning of the thigh portion and leg portion.

6 Claims, 23 Drawing Sheets

(56) References Cited

U.S. PATENT DOCUMENTS

| | | | | |
|---|---|---|---|---|
| 7,080,439 | B2 * | 7/2006 | Weinman | A47C 20/041 29/428 |
| 8,910,328 | B2 * | 12/2014 | Clenet | A61G 7/015 5/600 |
| 2004/0034934 | A1 * | 2/2004 | Weinman | A47C 20/041 5/618 |
| 2004/0194213 | A1 * | 10/2004 | Weinman | A61G 7/015 5/618 |
| 2005/0011005 | A1 * | 1/2005 | Borda | A47C 19/04 5/412 |
| 2005/0278850 | A1 * | 12/2005 | Weinman | A47C 20/041 5/618 |
| 2014/0020182 | A1 * | 1/2014 | Clenet | A61G 7/015 5/618 |
| 2015/0121624 | A1 * | 5/2015 | Clenet | A61G 7/018 5/618 |
| 2015/0190306 | A1 * | 7/2015 | Krueger | A61H 23/00 5/618 |

* cited by examiner

ARTICULATING BED WITH FLEXIBLE MATTRESS SUPPORT

REFERENCE TO RELATED APPLICATIONS

This application is a continuation-in-part of application Ser. No. 13/946,970 filed on Jul. 19, 2013 which claims priority of U.S. Provisional Application Ser. No. 61/673,878 filed on Jul. 20, 2012 both entitled ARTICULATING BED WITH FLEXIBLE MATTRESS SUPPORT and both having a common assignee with the present application, the disclosures of which are incorporated herein by reference.

BACKGROUND

Field

This invention relates generally to the field of adjustable beds and more particularly to a structure for an articulating bed having an integral adjustable lumbar support and head angle adjustment with a flexible mattress support.

Description of the Related Art

Articulating beds have long been used in hospital and healthcare facilities to allow positioning of a patient in a reclining position, sitting position, elevated leg position or combinations of these positions. General usage of articulating beds has been rapidly expanding due to the comfort and convenience available from adjusting the bed to desired positions for reading, general relaxation or sleeping.

The mechanical structure and drive mechanisms for such articulating beds must be able to support the weight of both a mattress and the occupant. Due to the size, weight, fabrication materials and configuration of the mattress and supporting structure, maintaining rigidity in the system may also be challenging. Typical articulating beds provide an upper body positioning element and a thigh and lower leg positioning element either individually active or with combined actuation. However, the articulating elements are typically rigid elements that extend in both a lateral and longitudinal dimension. These rigid elements may restrict the shaping of the mattress and create zones in the bed that are not ergonomically ideal.

One noted disadvantage of articulating bed systems when both the upper body positioning element and the leg positioning elements are elevated is the tendency for positioning of the lower back in a curved posture which may result in undesirable lumbar strain. Lumbar positioning or support elements have been proposed. However, adjustment elements have tended to adversely reposition, strain or damage the mattress.

Similarly, head angle with most articulated beds with the upper body positioning element in the elevated position is not satisfactory due to the linear alignment of the head and body. Adjustment systems for creating an angled relationship between the upper body portion of the mattress and a portion wherein the head rests have also been available but actuation systems have proved to be complicated or unsightly since the upper body portion articulating element is exposed in the elevated position It is therefore desirable to provide an articulating bed having a flexible mattress support member and providing lumbar support adjustment with reduced mattress interference and a head portion adjustment with simple and unimposing actuation elements.

SUMMARY

The embodiments disclosed herein overcome the shortcomings of the prior art by providing an articulating bed incorporating a frame having side frame members and a rigid cross frame member extending between the side frame members which employs a flexible support member having an upper body flex element and a lower body flex element secured to the rigid cross frame member. Support arms engage an upper body portion of the upper body flex element with lubricious support and are rotatable through a range of motion from an aligned position with the side frame members to a fully elevated position angularly supporting the upper body portion in a raised position. A leg portion adjustment member engages the lower body flex element at a knee position intermediate a thigh portion and a leg portion of the lower body flex element. The leg portion adjustment member is rotatable through a range of motion from an aligned position with the side frame members to a fully elevated position placing the knee position at an elevated location with angular positioning of the thigh portion and leg portion.

In an alternative embodiment, the articulating bed incorporates a frame having side frame members and a rigid cross frame member extending between the side frame members. The flexible support member has a central flexible portion secured to the rigid cross frame member and a rigid upper body element attached to the central flexible portion at a peripheral edge. The support arms engage the rigid upper body element with a plurality of shuttles movable on the support arms, the support arms rotatable through a range of motion from an aligned position with the side frame members to a fully elevated position angularly supporting the rigid upper body element in a raised position.

In a further alternative embodiment, the articulating bed incorporates a frame having side frame members and a rigid cross frame member extending between the side frame members with the flexible support member secured to the rigid cross frame member. A rigid upper backing element is engaged to the flexible support member proximate an upper body portion. An actuating assembly engages a lower surface of the rigid upper backing element and the actuating assembly is rotatable through a range of motion from an aligned position with the side frame members to a fully elevated position angularly supporting the upper body portion in a raised position.

BRIEF DESCRIPTION OF THE DRAWINGS

These and other features and advantages of the present invention will be better understood by reference to the following detailed description of exemplary embodiments when considered in connection with the accompanying drawings wherein.

DETAILED DESCRIPTION

Figure 1:
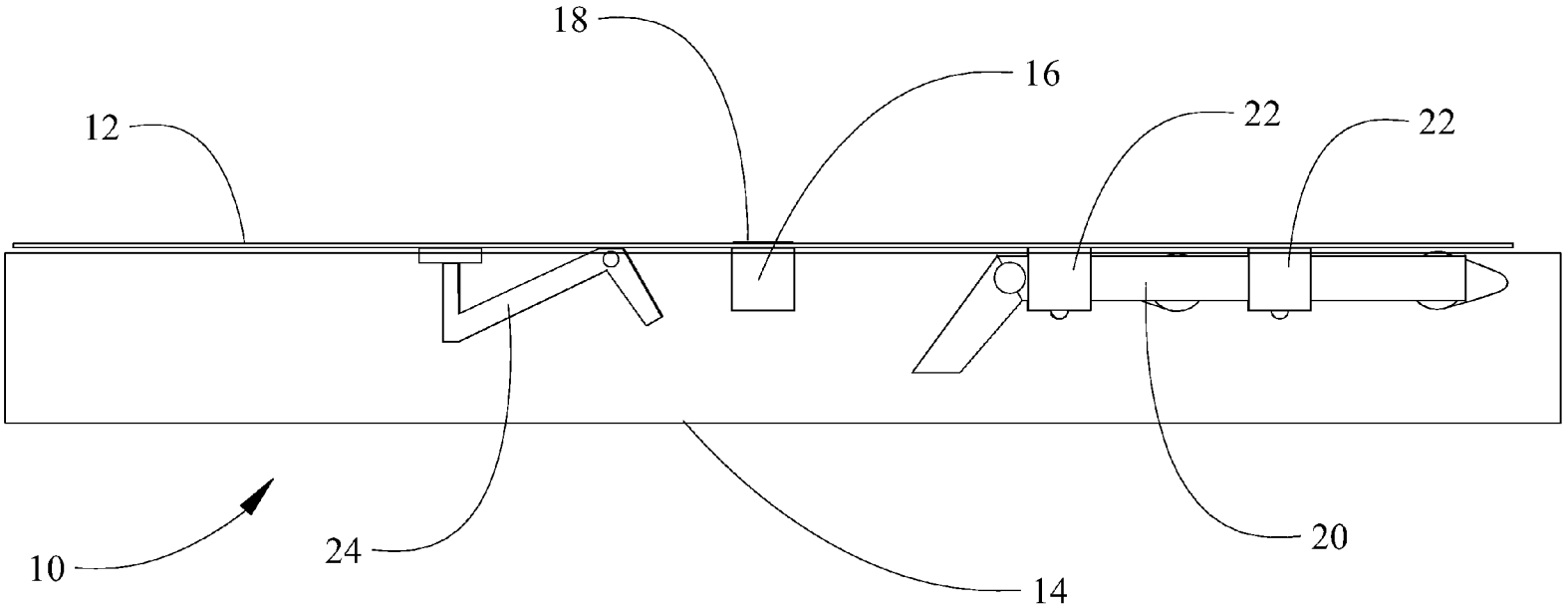
FIG. 1 is a side view of the adjustable bed system without side supports and the flexible member flat.
Figure 2:
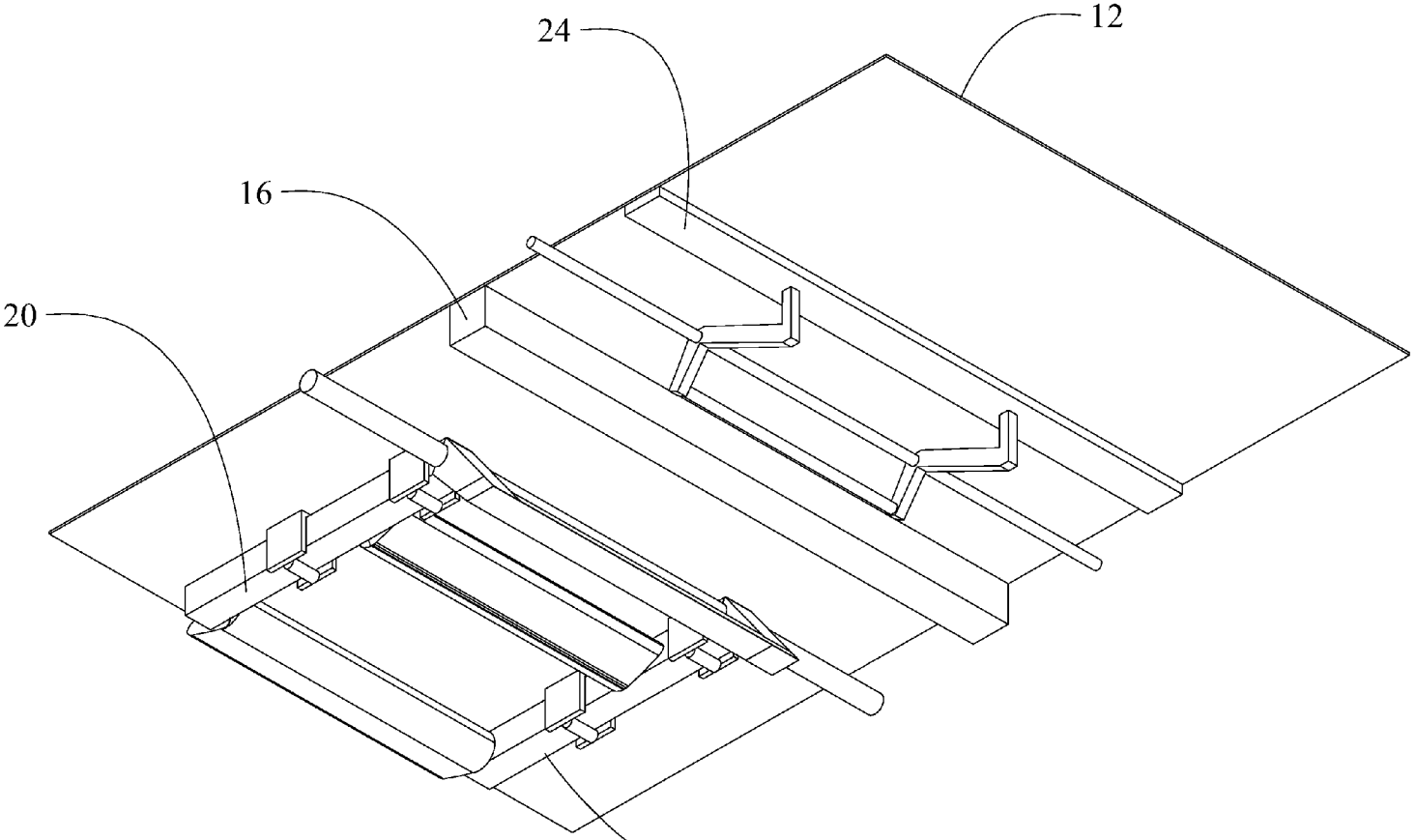
FIG. 2 is a pictorial view from under the bed.
Figure 3:
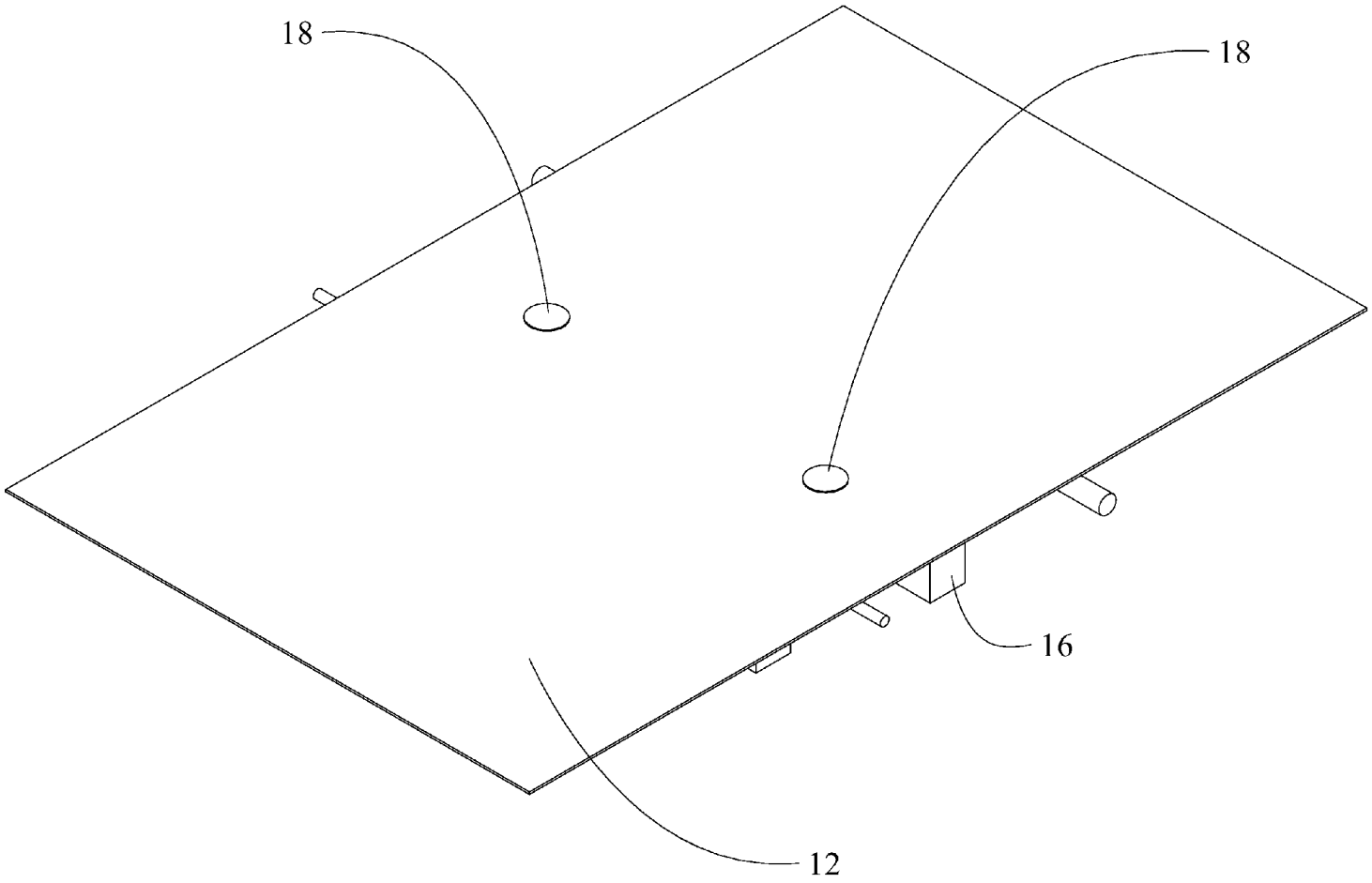
FIG. 3 is a top pictorial view of the bed with the flexible member flat showing the securing discs.

Embodiments shown in the drawings and described herein provide an actuation system for an articulating bed which eliminates the rigid individual support platforms and uses a continuous flexible support member for the mattress. Referring to the drawings, FIGS. 1 and 2 show the adjustable bed system 10 which incorporates a flexible support or member 12 to support a mattress (shown in later figures). The flexible support in an exemplary embodiment is a ⅛ inch sheet of fiber reinforced plastic (FRP) which is fire resistant (FR). Side frame members 14 support a cross member 16 to which the flexible member 12 is secured using plates or discs 18 (best seen in FIG. 3) with bolts extending through the FRP. Rotatable upper body support arms 20 support an upper body portion 13 of the flexible support member 12 toward the upper end of the bed. The flexible support member 12 is lubriciously supported on the support arms 20 to reposition itself during motion of the support arms. In one example embodiment, shuttles 22 which are supported on the support arms 20 are attached to the flexible support member 12. A leg portion adjustment member 24 is positioned to contact the flexible support member at approximately the knee position 25 of a user between a thigh portion 15 and lower leg portion 19 of the flexible support member 12. The side frames may include insets which receive the edges of the flexible support member 12 in the flat condition.

Figure 4:
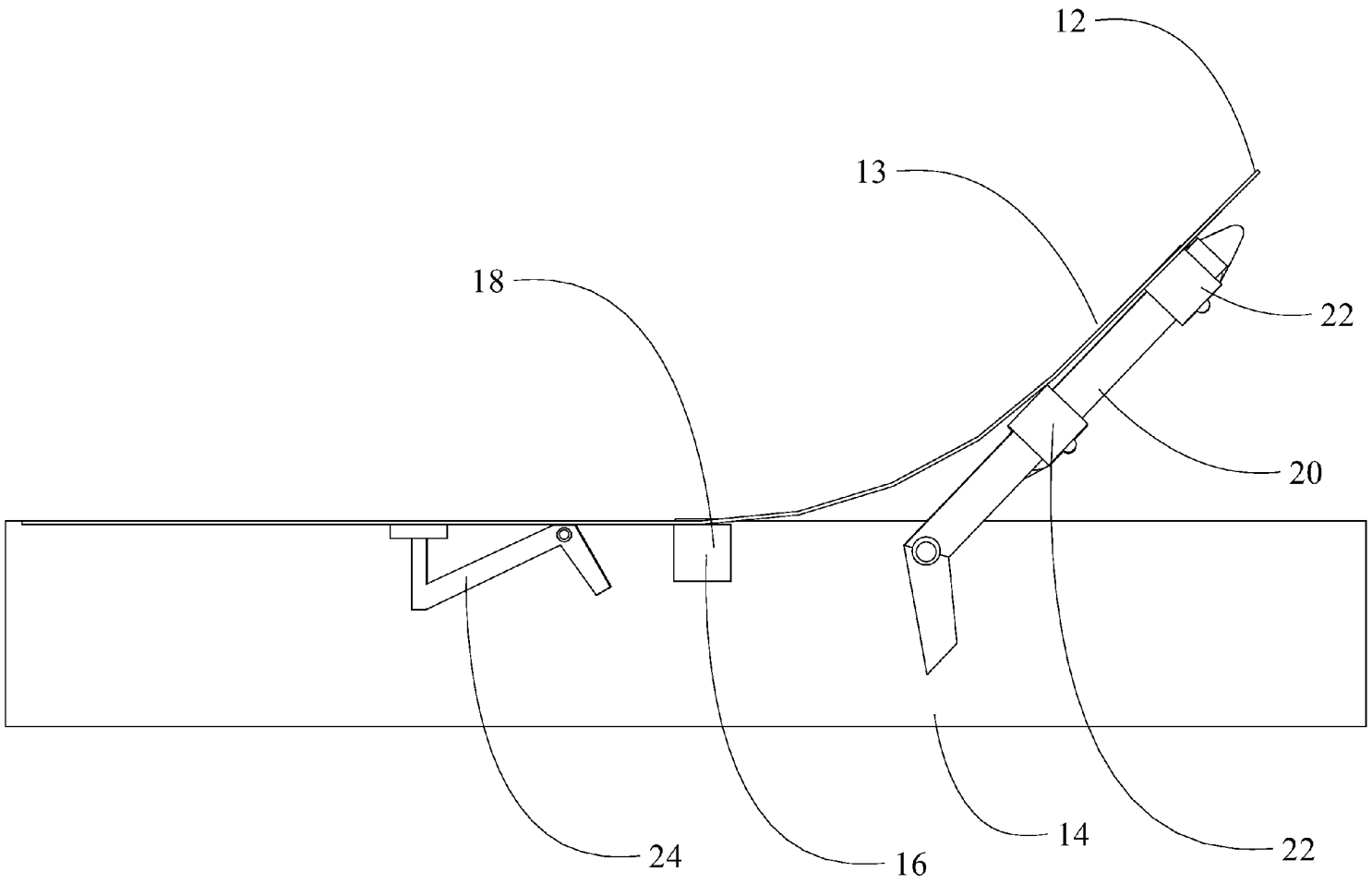
FIG. 4 is side view of the adjustable bed system with the upper body portion raised.
Figure 5:
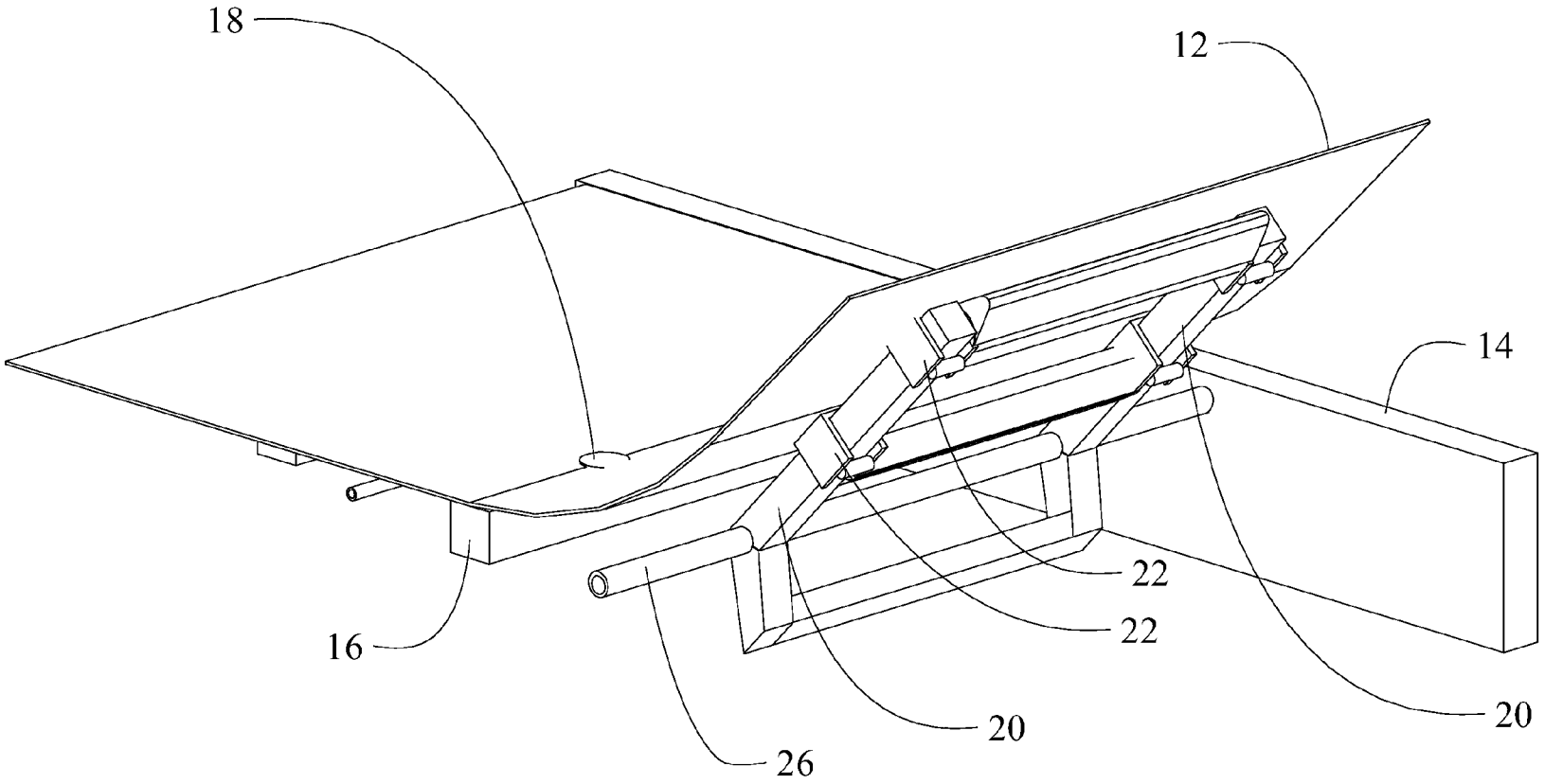
FIG. 5 is a pictorial view of the bed with the head portion raised.

As seen in FIGS. 4 and 5, the upper body portion 13 of the flexible support member 12 may be raised by rotating the upper body support arms 20 about axles 26 extending to and supported by the side frame members 14. Actuation levers 21 on the support arms 20 may be attached to an actuator 23 for rotation. The shuttles 22 reciprocate along the support arms 20 to maintain the flexible support member 12 in contact with the support arms at desired points for proper shaping of the mattress including extension of lumbar and neck angle adjustment elements as will be described in greater detail subsequently.

Figure 6:
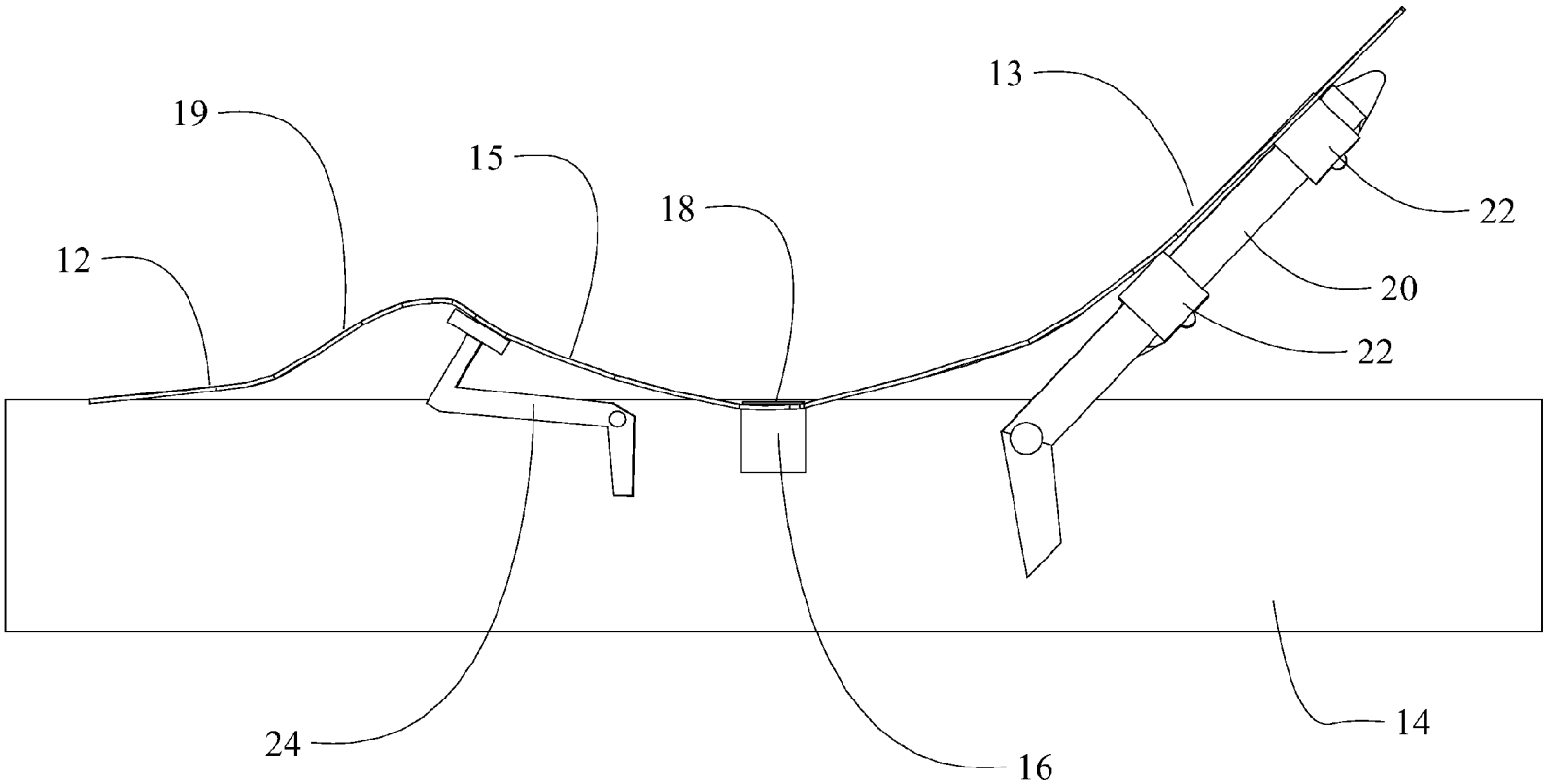
FIG. 6 is a side view of the bed with the head portion and leg portion raised.
Figure 7:
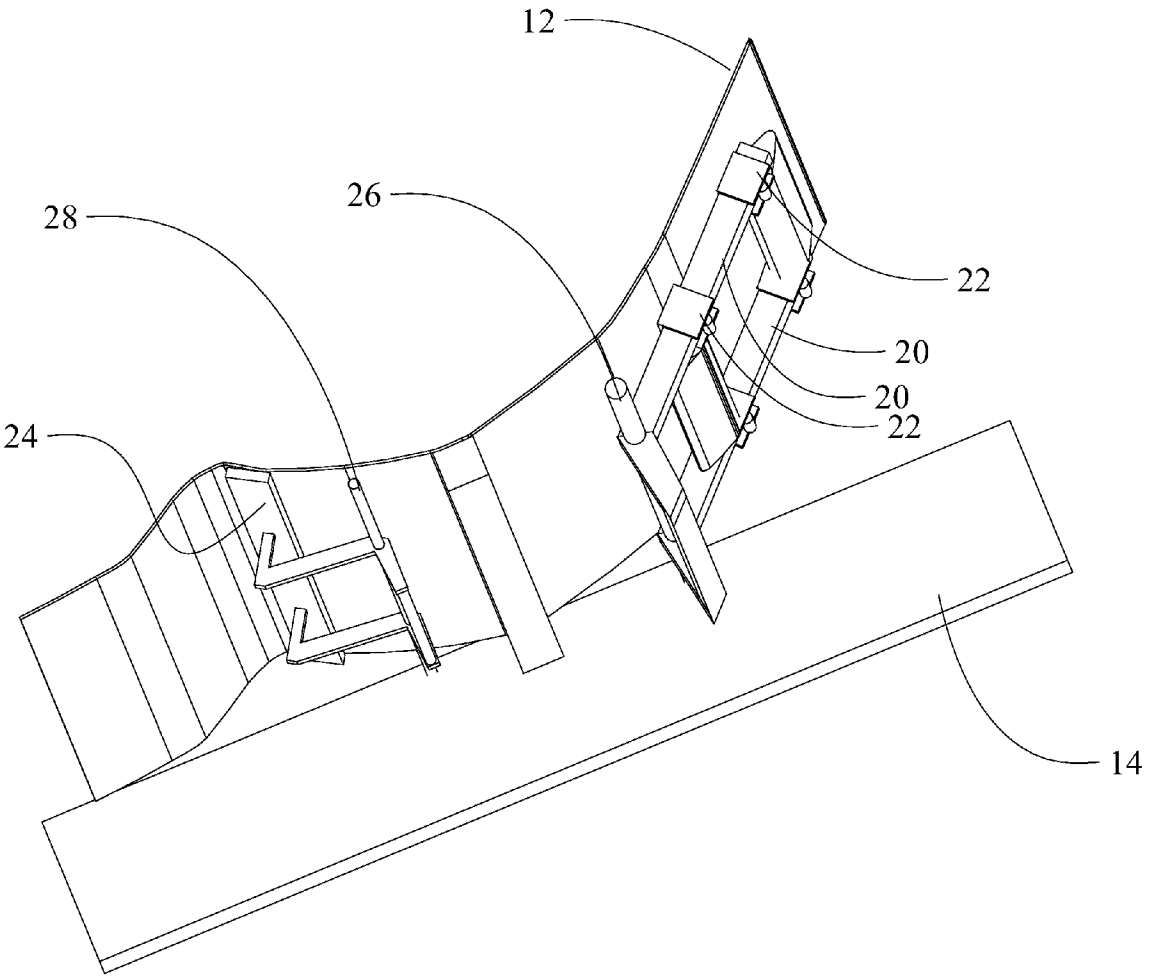
FIG. 7 is a pictorial view of the bed with the head and leg portions raised
Figure 8:
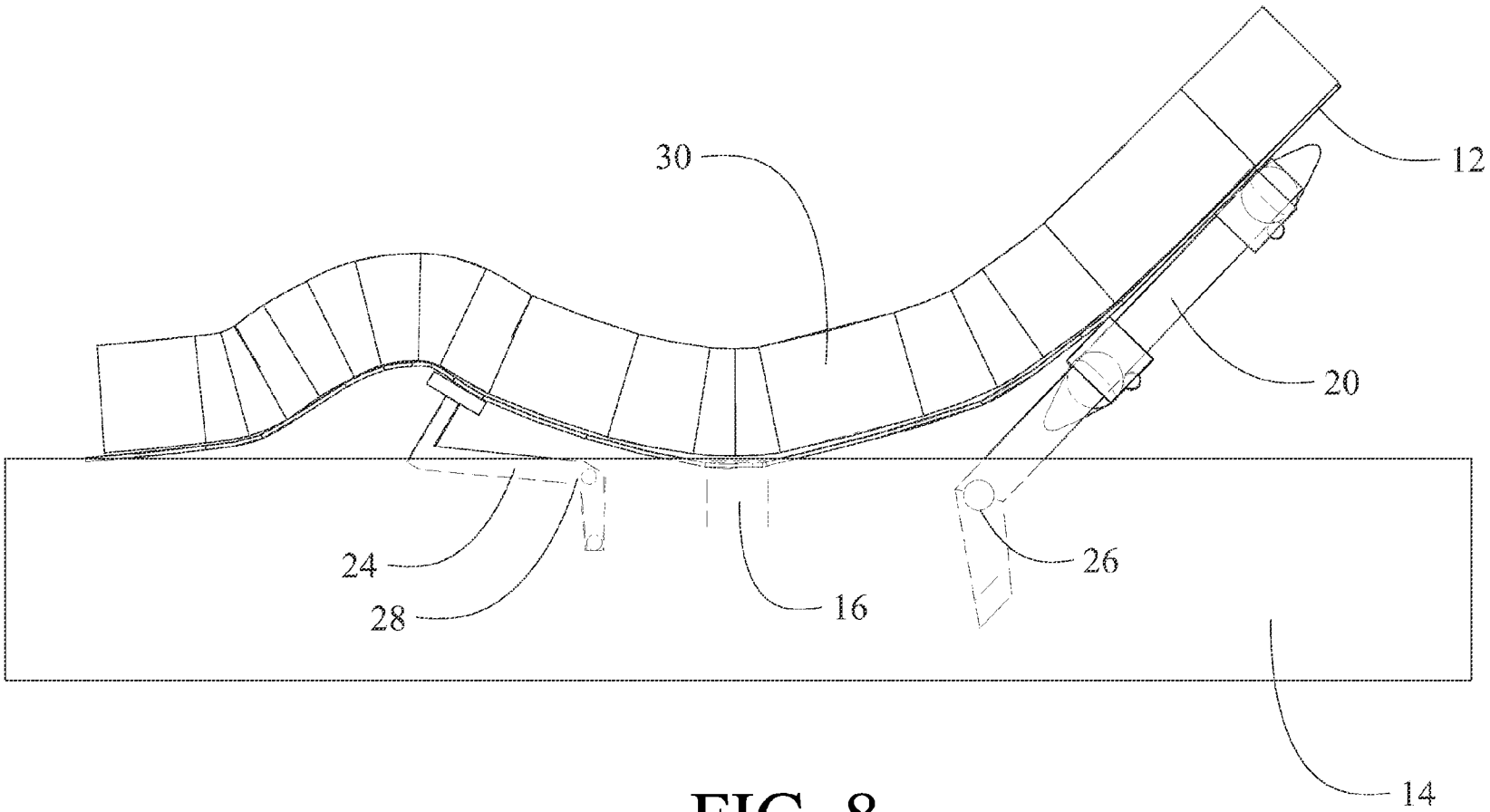
FIG. 8 is a side hidden line view of the bed with the head and leg portions raised and a mattress in place.
Figure 9:
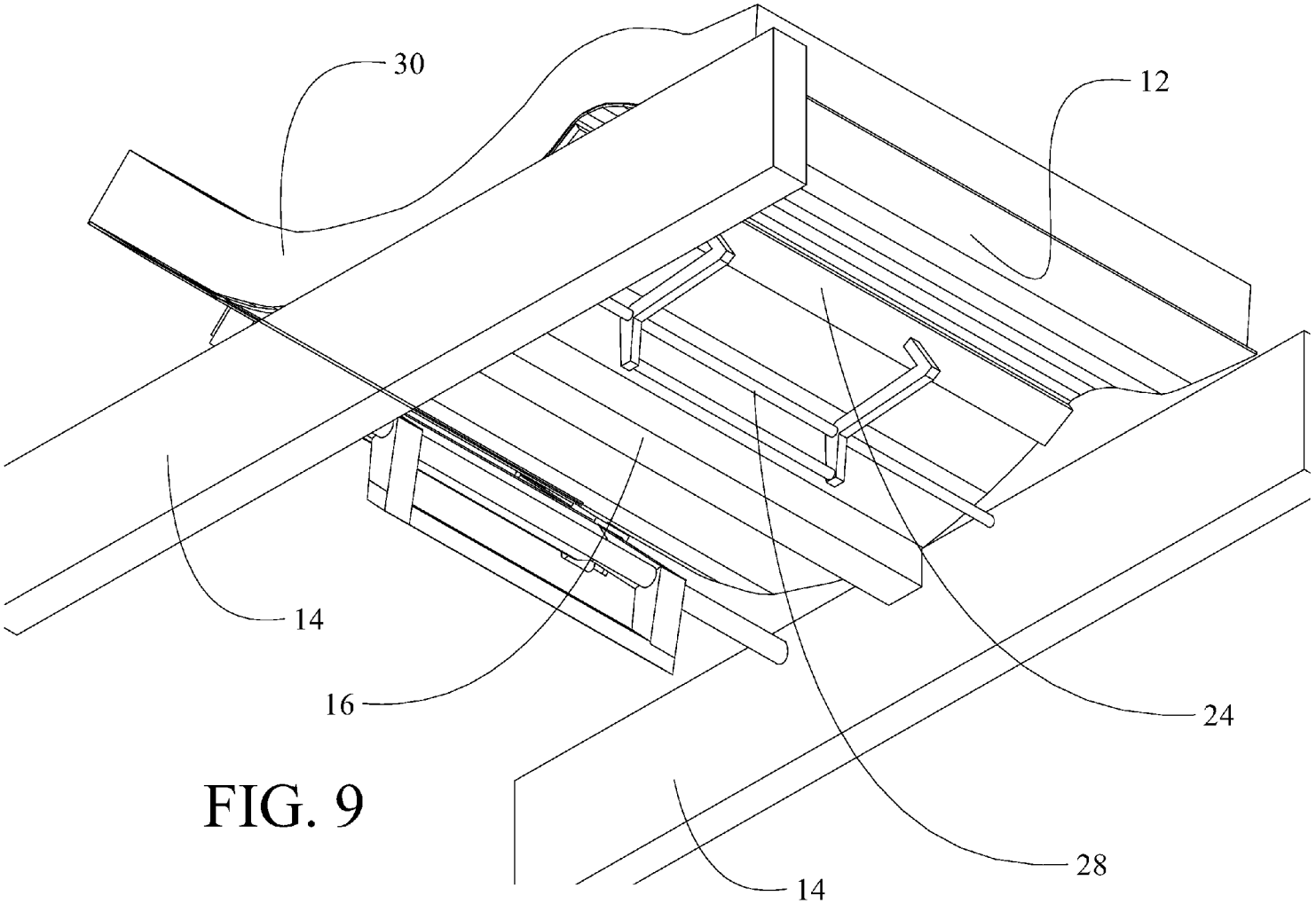
FIG. 9 is a pictorial view with the mattress in place.

As shown in FIGS. 6 and 7, the leg portion adjustment member 24 may be rotated about axle 28 which raises the flexible support member 12 at the knee position of the user. The flexible support member 12 flexes over the rotated leg portion adjustment member seeking a neutral position with the thigh portion 15 and lower leg portion 19 draped over the leg portion adjustment member 24. The flexible support member 12 establishes a smooth curvature in both the upper body portion 13 and thigh and lower leg portions 15, 19 of the bed based on natural flexing with the center of the member secured at the rigid cross member 16. FIGS. 8 and 9 show the bed in the actuated position for the upper body portion, thigh portion and lower leg portion with a mattress 30 resting on the flexible support member 12. In prior art beds, mattresses tend to lift from the support platforms in the articulated position. The flexible support member 12 naturally contours the angles of the articulation to better maintain the positioning of the mattress on the support member. In addition, mattress retainers such as those disclosed in U.S. patent application Ser. No. 13/367,616 entitled Mattress Retainer System for an Adjustable Bed having a common assignee with the present application, the disclosure of which is incorporated herein by reference, may be used to constrain the mattress to the flexible support member 12 at the head and foot.

Figure 10:
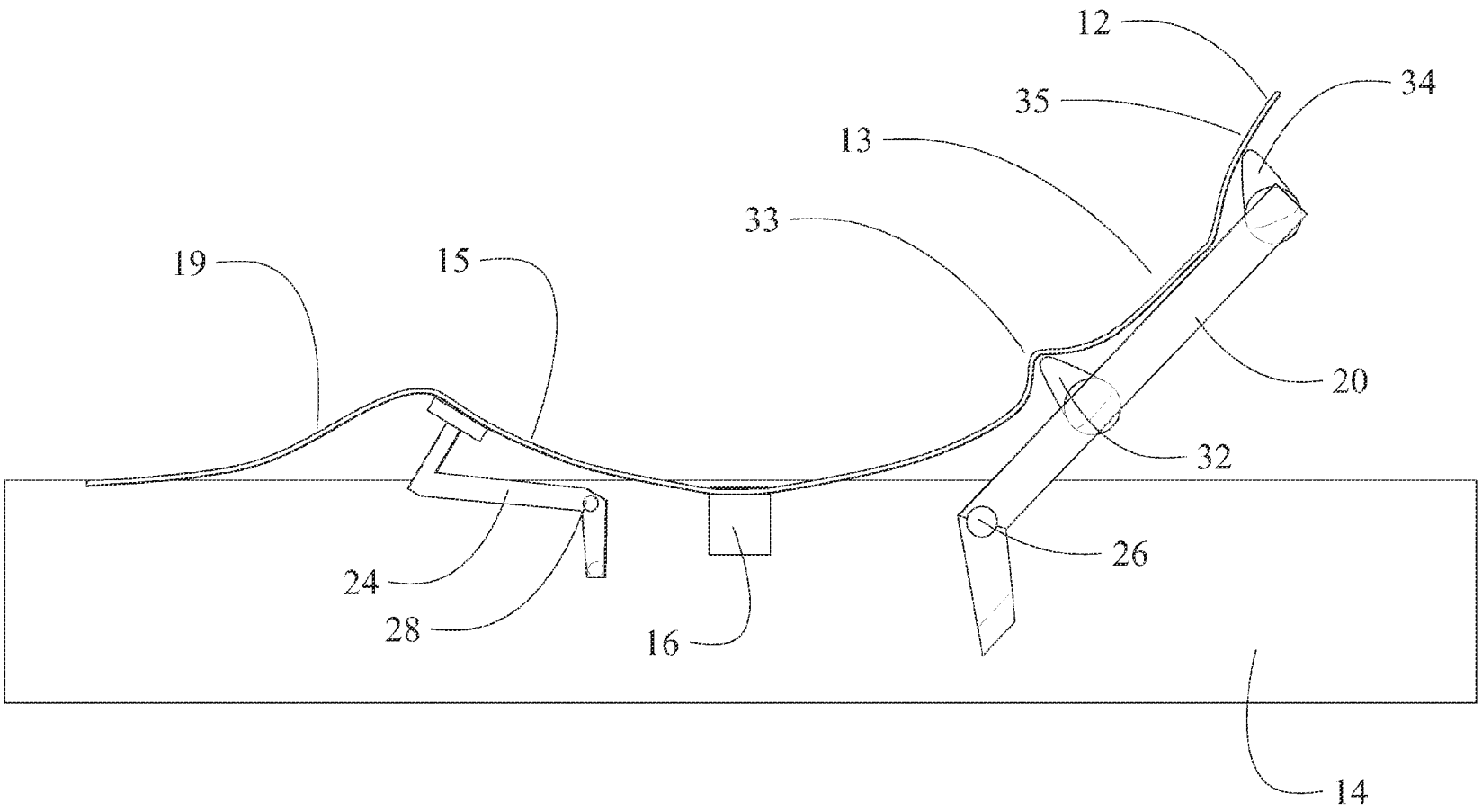
FIG. 10 is a side hidden line view of the bed with the head adjustment and lumbar adjustment activated.
Figure 11:
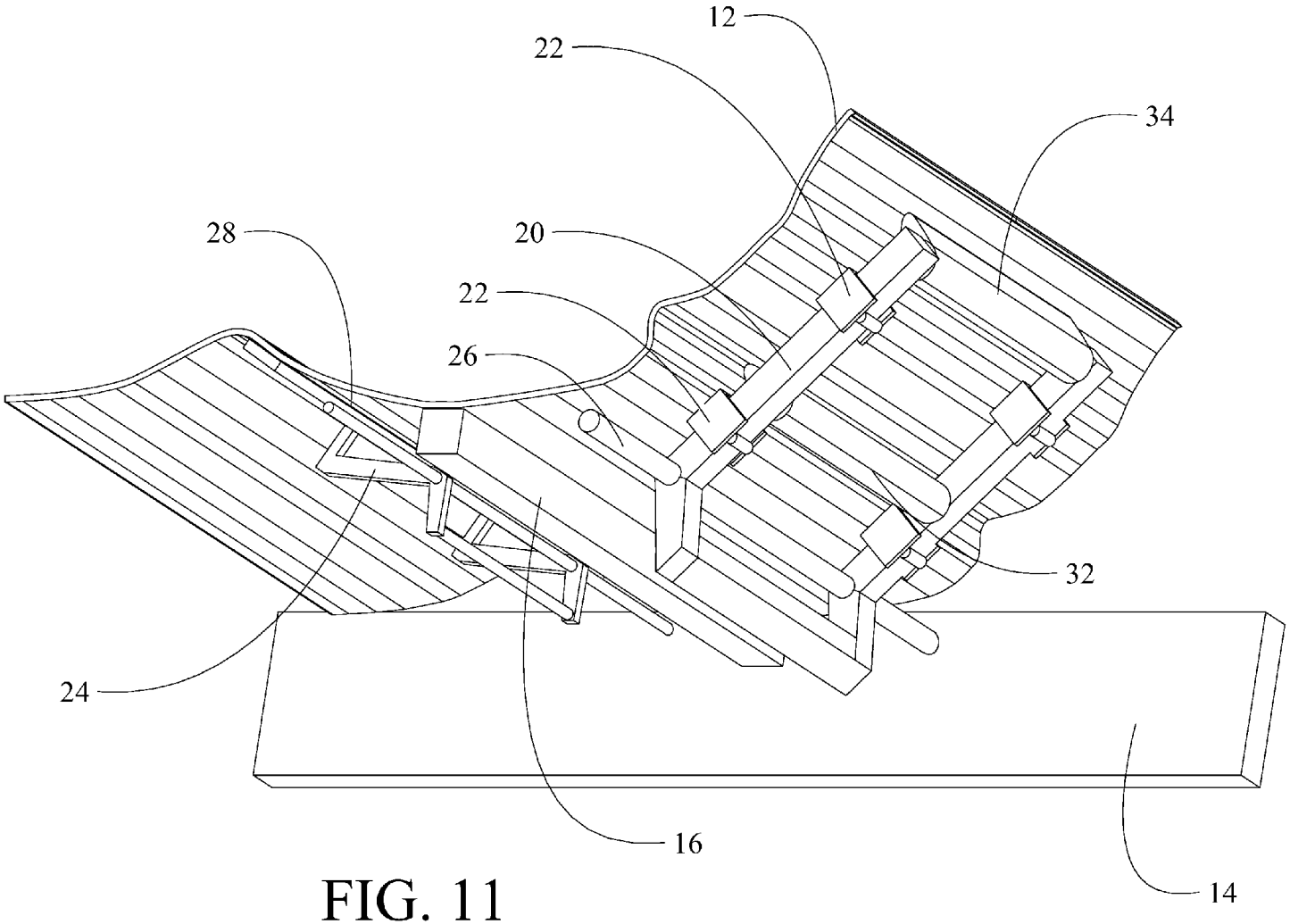
FIG. 11 is a pictorial view with the head adjustment and lumbar adjustment activated.
Figure 12:
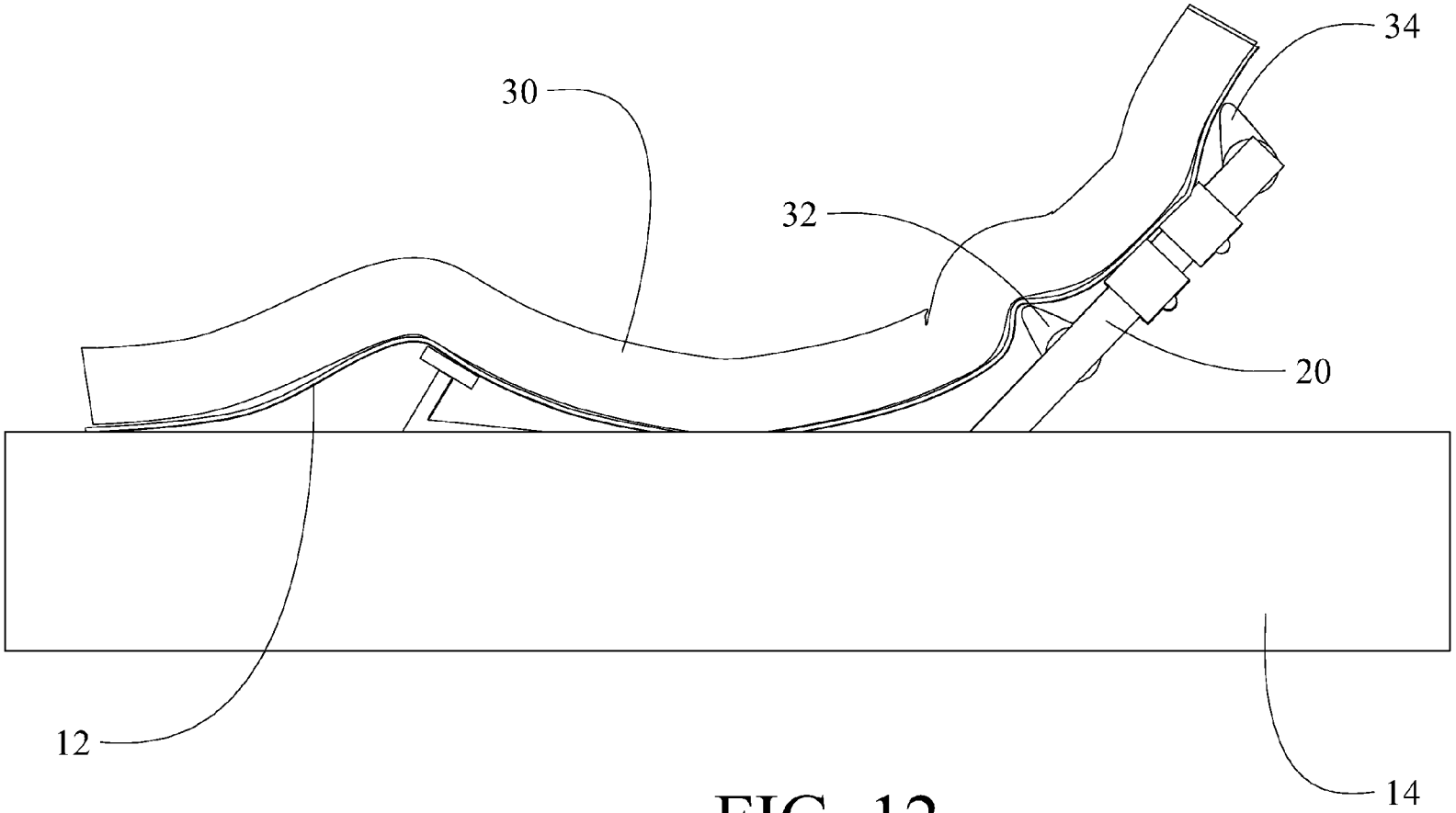
FIG. 12 is a pictorial view as in FIG. 11 with a mattress installed.

Additionally, the flexible nature of the flexible support member 12 allows the addition of specific contouring elements for lumbar support and head angle position. As shown in FIGS. 10 and 11, a lumbar positioning element is provided by a first rotatable cam element 32 attached between the upper body support arms 20 is rotated to flex the flexible support member 12 outward in a lumbar portion 33. As shown in FIG. 12 the mattress 30 adopts the flexed position providing gently curving additional support in the lumbar region of the users back. Similarly, a neck angle adjustment element is provided by a second rotatable cam element 34 attached between the upper body support arms 20 rotatable to flex the flexible support member 12 outward in a head portion 35 to provide additional angled support for the users head.

Figure 13A:
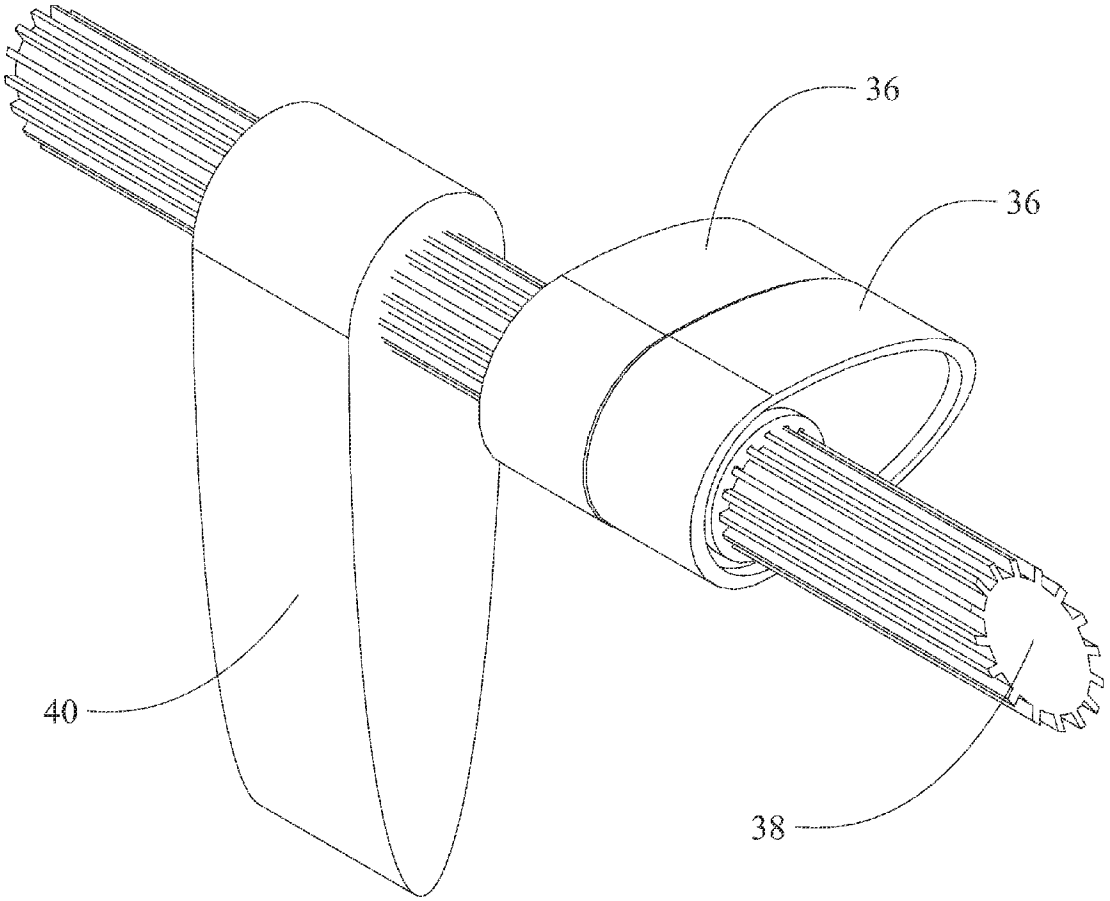
FIG. 13A is an isometric view of an exemplary components for the cam element.
Figure 13B:
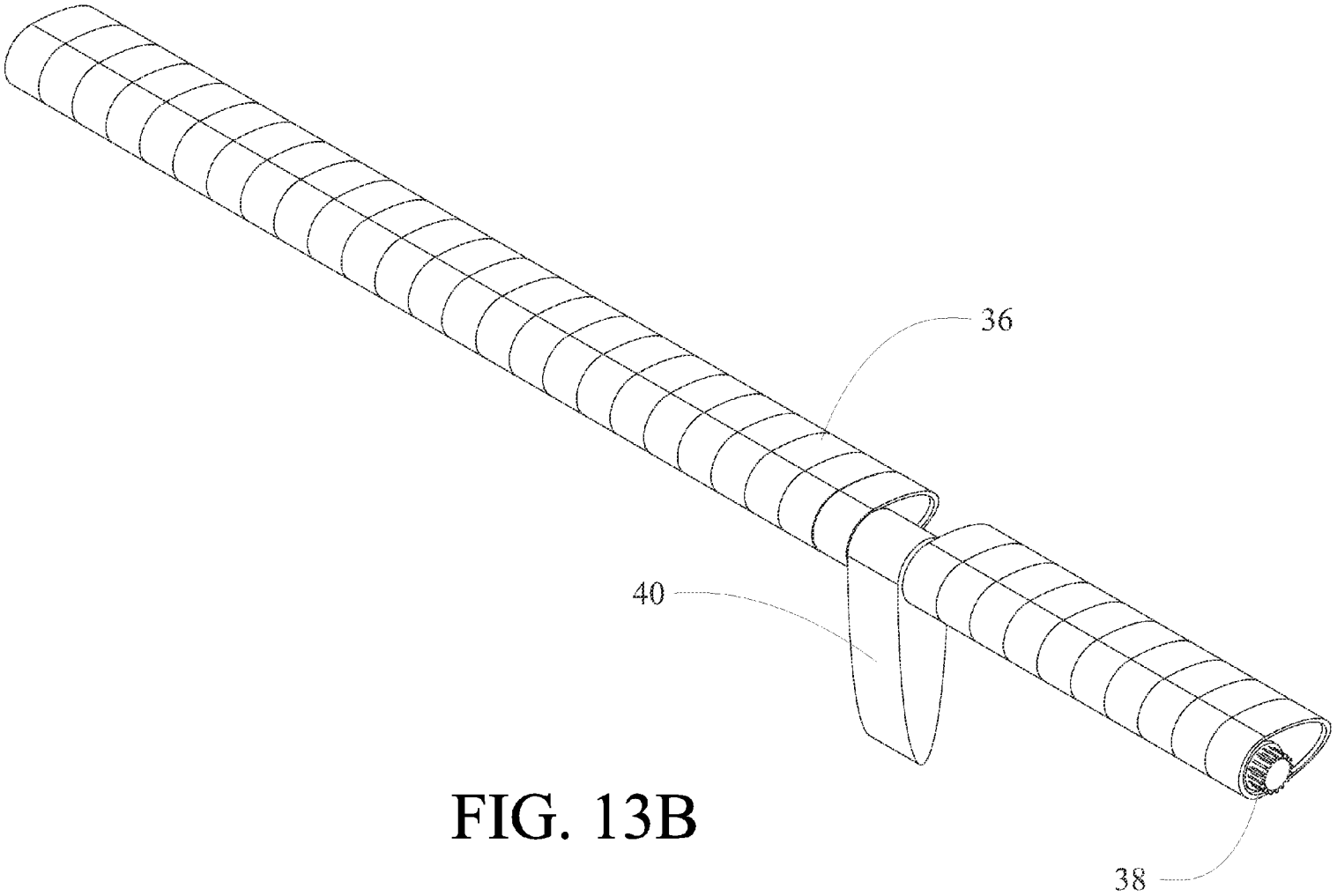
FIG. 13B is an isometric view of the cam element with a rotation lever incorporated.

The cam elements 32, 34 may be formed from multiple cam segments 36 as shown in FIG. 13A which are mounted on a splined shaft 38 to create a cam element of the desired width for the articulating bed. A rotation lever 40 adapted to receive the splined shaft may be interspersed in the cam elements at a desired location for attachment to an actuator as shown in FIG. 13B. In alternative embodiments, one cam segment may integrate the rotation lever. Rotation of the splined shaft results in concerted rotation of the multiple cam segments. Additionally, while shown in the drawings as extending the entire width of the splined shaft, the cam segments 36 may be positioned over only a portion of the shaft width to tailor the lumbar or neck angle adjustment cam elements to engage a portion or selected portions of the flexible support member 12 and hence the mattress.

Figure 14A:
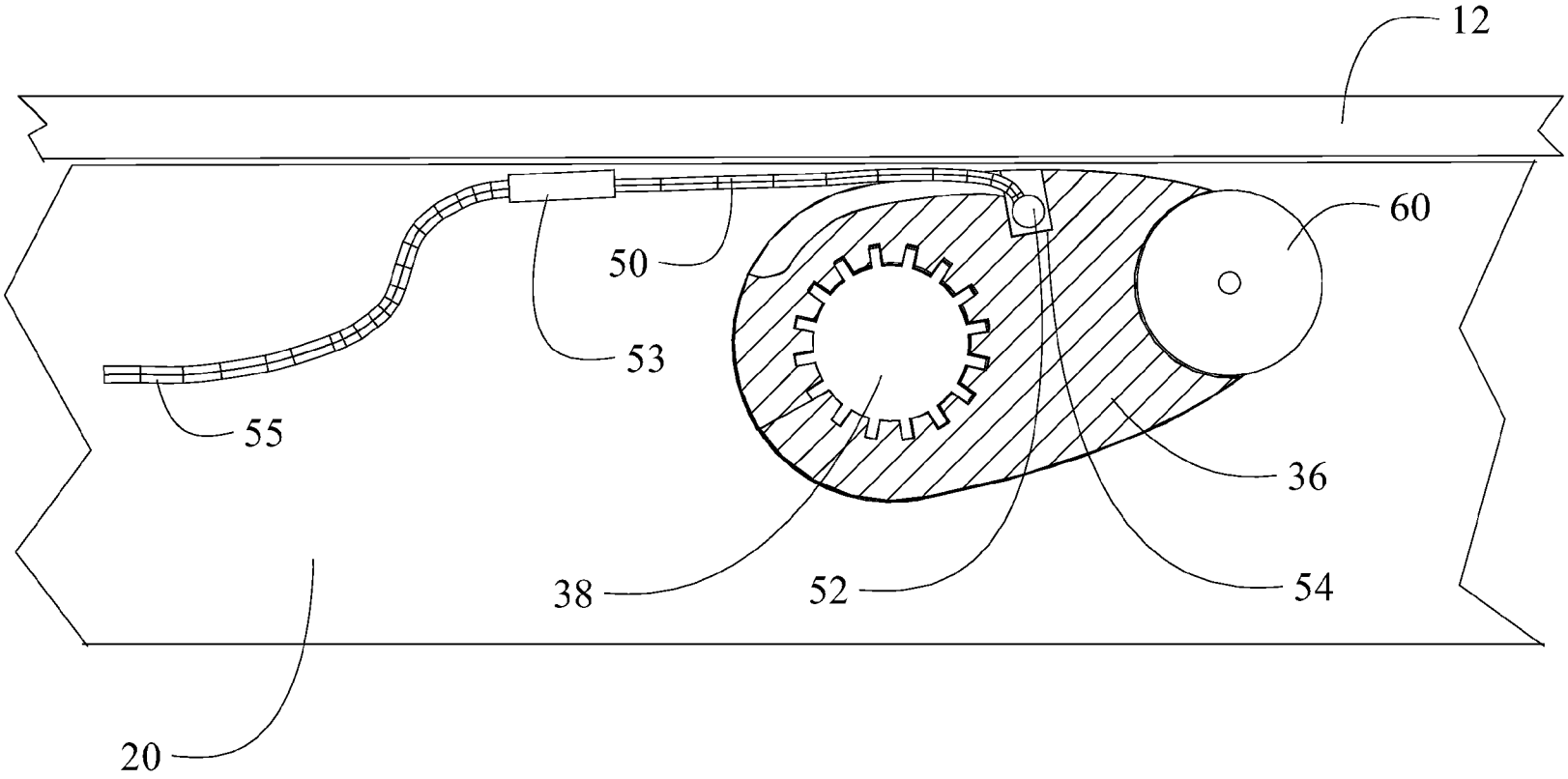
FIG. 14A is an isometric view of an alternative cable actuation system for the cam element.
Figure 14B:
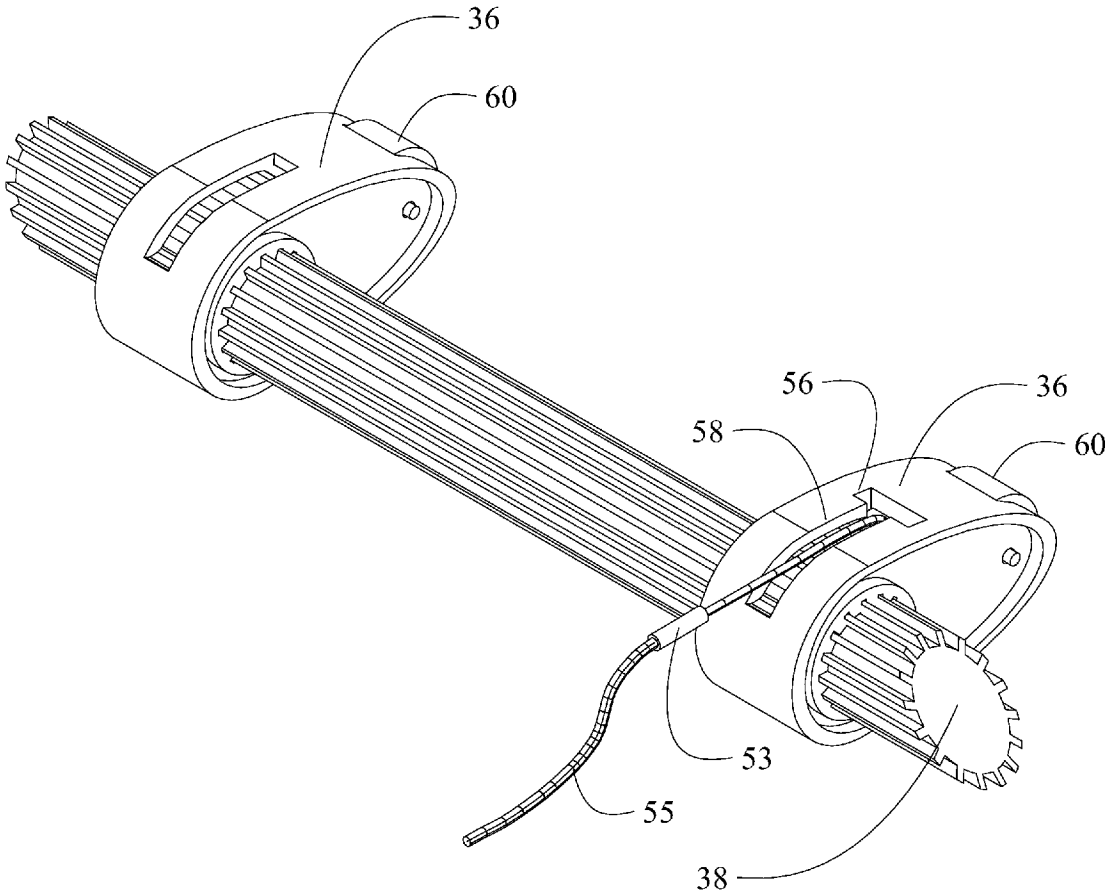
FIG. 14B is an isometric view of the assembled cam element of FIG. 14A.
Figure 14C:
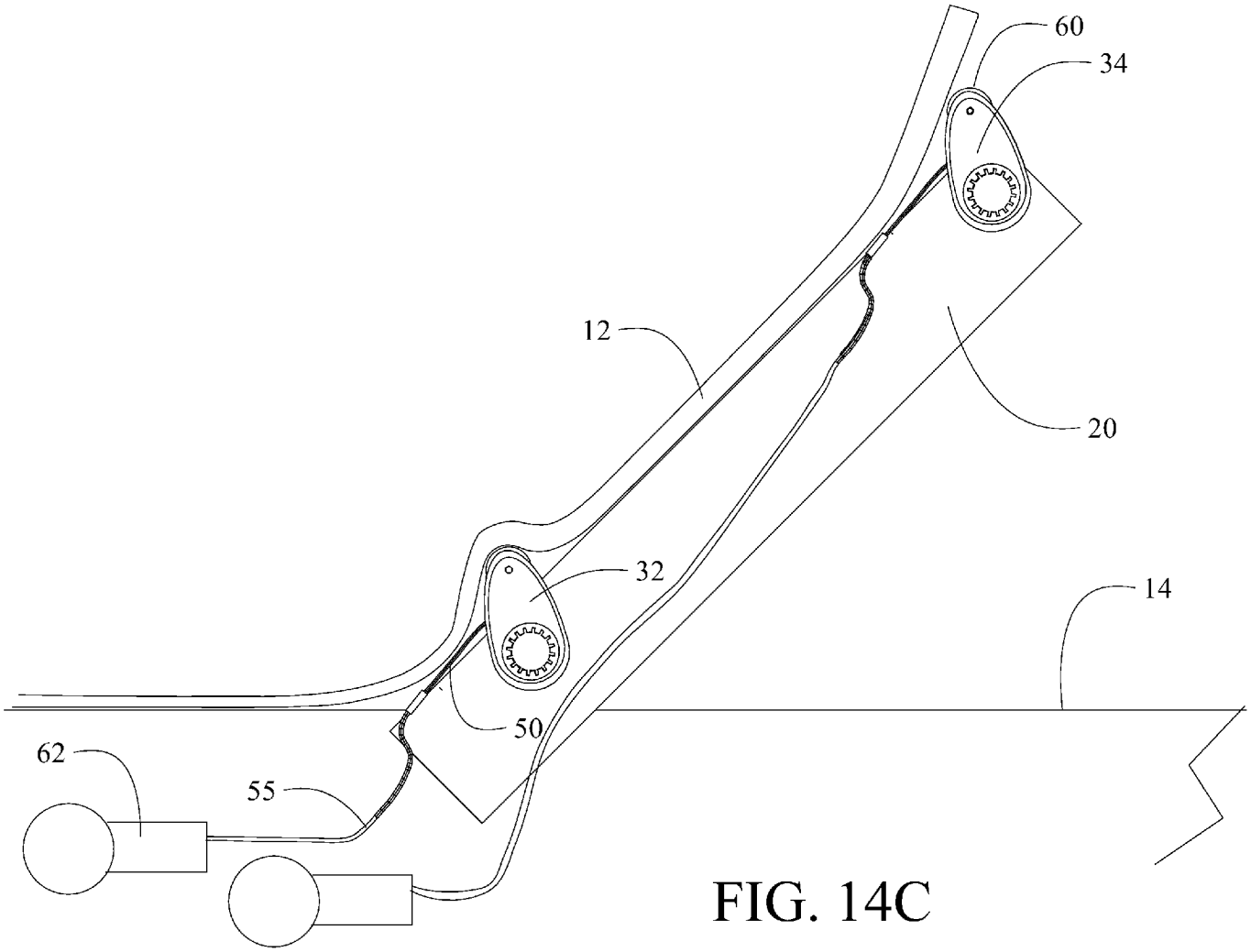
FIG. 14C is a side view of the actuator arrangement for the cable actuation system.

Actuation of the cam elements is accomplished in alternative embodiments through the use of a sheathed cable 50 as shown in FIGS. 14A-C. The cam segment 36 engages a key 52 on the end of cable 50 in a relief 54. A lateral slot 56 allows installation of the key into the relief while an adjoining longitudinal slot 58 engages the cable for operation. A securing lug 53 on a sheath or housing 55 for the cable attached to the support arm 20 provides actuation support for the cable. As shown in FIG. 14B, the cable 50 extends from the cam segment and, upon tensioning of the cable rotates the cam segment and splined shaft 38 which in turn rotates additional cam segments. Relaxation of the tension on the cable allows the cam segments to rotate back to a flush position with the support arms 20 as shown in FIG. 14A. Engagement of the flexible support member 12 by the cam segments may rely on lubricious surface engagement between the cam segments and the under surface of the flexible support member or wheels 60 may be included on the engagement ends of the cam segments as shown in FIGS. 14A and 14B. Cables for actuation of both the lumbar positioning first cam element 32 and the head angle positioning second cam element 34 may be routed to actuators mounted remotely from the actual cam elements. Use of the cable for actuation of the cam element allows placement of an actuator 62 within the frame on the side frame member 14 or other hidden location for actuation through tensioning of the cable providing a very clean appearance for the exposed structure of the articulated bed as shown in FIG. 14C.

Figure 15:
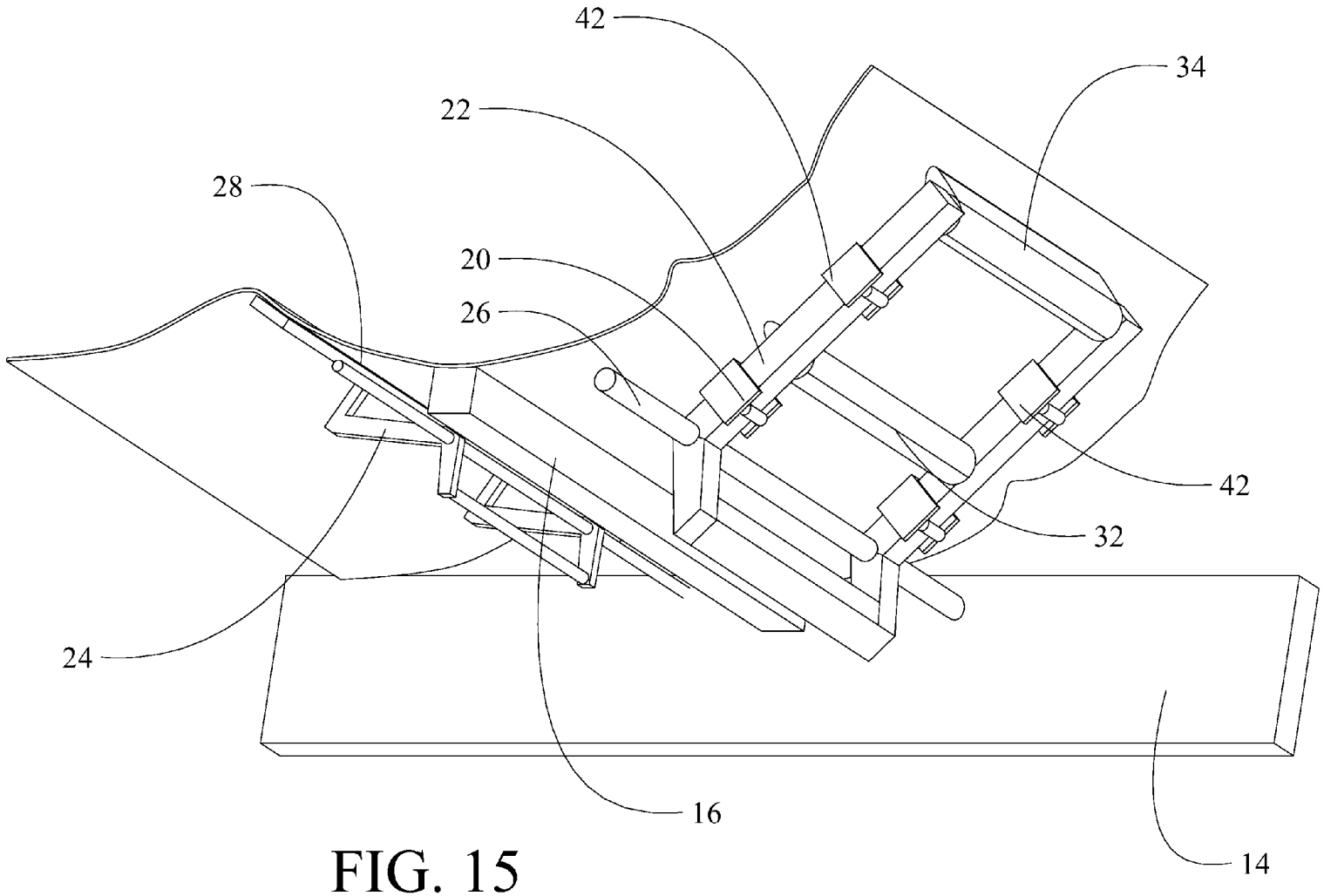
FIG. 15 is an alternative embodiment of the support arm shuttle.

Shaping of the displacement of the flexible support member 12 by the cam elements 32, 34 for the lumbar and neck angle support is accomplished by positioning and constraint of the shuttles 22 on the support arms 20. As shown in FIG. 15, the multiple shuttles shown in FIGS. 1-11 may be replaced by a single shuttle 42 on each support arm intermediate the lumbar cam element 32 and neck angle cam element 34. Motion of the shuttle 42 is constrained between the lumbar cam element 32 and neck angle adjustment cam element 34 thereby naturally shaping the flexible support member over the cam elements when activated. Constraint of the flexible support member 12 at the shuttle 42 and rigid cross member 16 provides shaping of the flexible support member in response to rotation of the lumbar cam element as shown in FIG. 15.

Figure 16:
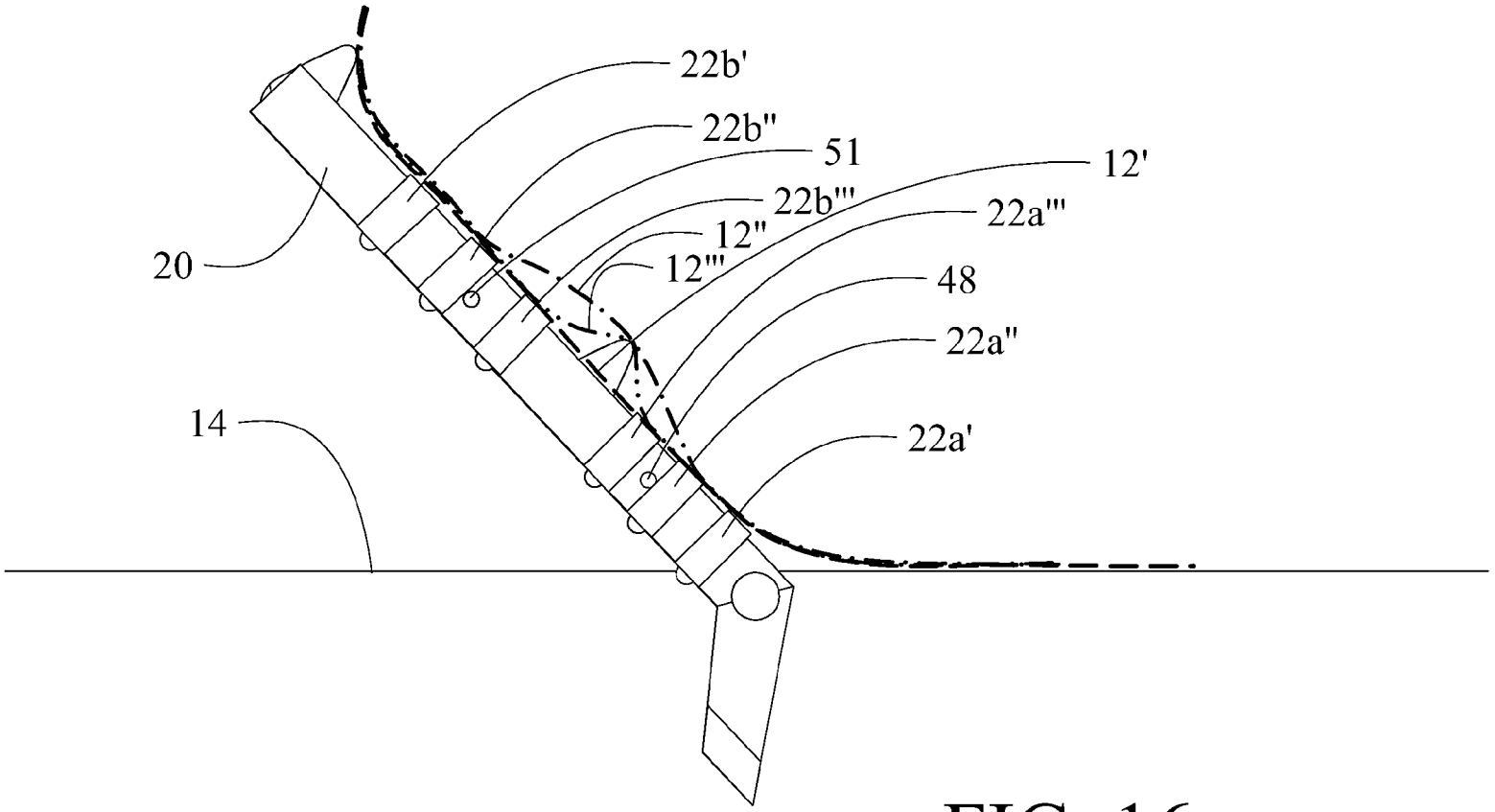
FIG. 16 is a side view of the shuttles at various positions for constraining the lumbar support shape.

Alternatively one or both of the shuttles 22*a* and 22*b* may be constrained for motion along the support arms 20 at defined extents to provide specific shaping curvature of the flexible support member 12 in response to adjustment of the lumbar and neck angle cam elements. As an example, as shown in FIG. 16, shuttle 22*a* may be unconstrained in a lower initial position 22*a*' in response to a first retracted position of the lumbar support with shuttle 22*b* unconstrained in an upper position 22*b*' and the flexible support flat as shown by profile 12'. Upon rotation of the lumbar support cam element 32 into an extended position, shuttle 22*a* is drawn upward along the support arm 20 to a second position designated by 22*a*", however, to provide a desired curvature for the lumbar region of the flexible support member as shown by profile 12" and mattress, the shuttle 22*a* may be constrained by a stop 48 in the upper second position. Similarly, shuttle 22*b* is unconstrained in an upper initial position 22*b*' with the lumbar support retracted and upon rotation of the lumbar cam element 32 is drawn downward along the support arm 20 to a lower second position 22*b*". A stop 51 may be employed in to define the lower second position 22*b*". The initial positions of shuttles 22*a* and 22*b* are responsive to the position of the upper body portion of the flexible support member 12 as positioned by the angle of the support arms 20. The position stops may chosen to provide any desired profile by positioning of the shuttle as shown by an exemplary third lower position 22*a*'" and 22*b*'" with flexible support profile 12'"

Similarly, the stop 51 may limit downward travel of shuttle 22*b* in response to activation of the head angle cam element 34. As shown in FIG. 16 shuttle 22*b* may reside unconstrained in an upper initial position 22*b*' with the head angle in alignment with the upper body portion of the flexible support member. Upon rotation of the head angle cam element 34 to raise the head angle, shuttle 22*b* may translate downward to a lower second position 22*b*" with further downward translation of the shuttle constrained by stop 51.

The stops and shuttle positioning may additionally be adjustable for varying the curvature associated with the lumbar positioning element for different mattress thickness and/or stiffness as shown by positions 22*a*'" and 22*b*'".

Figure 17:
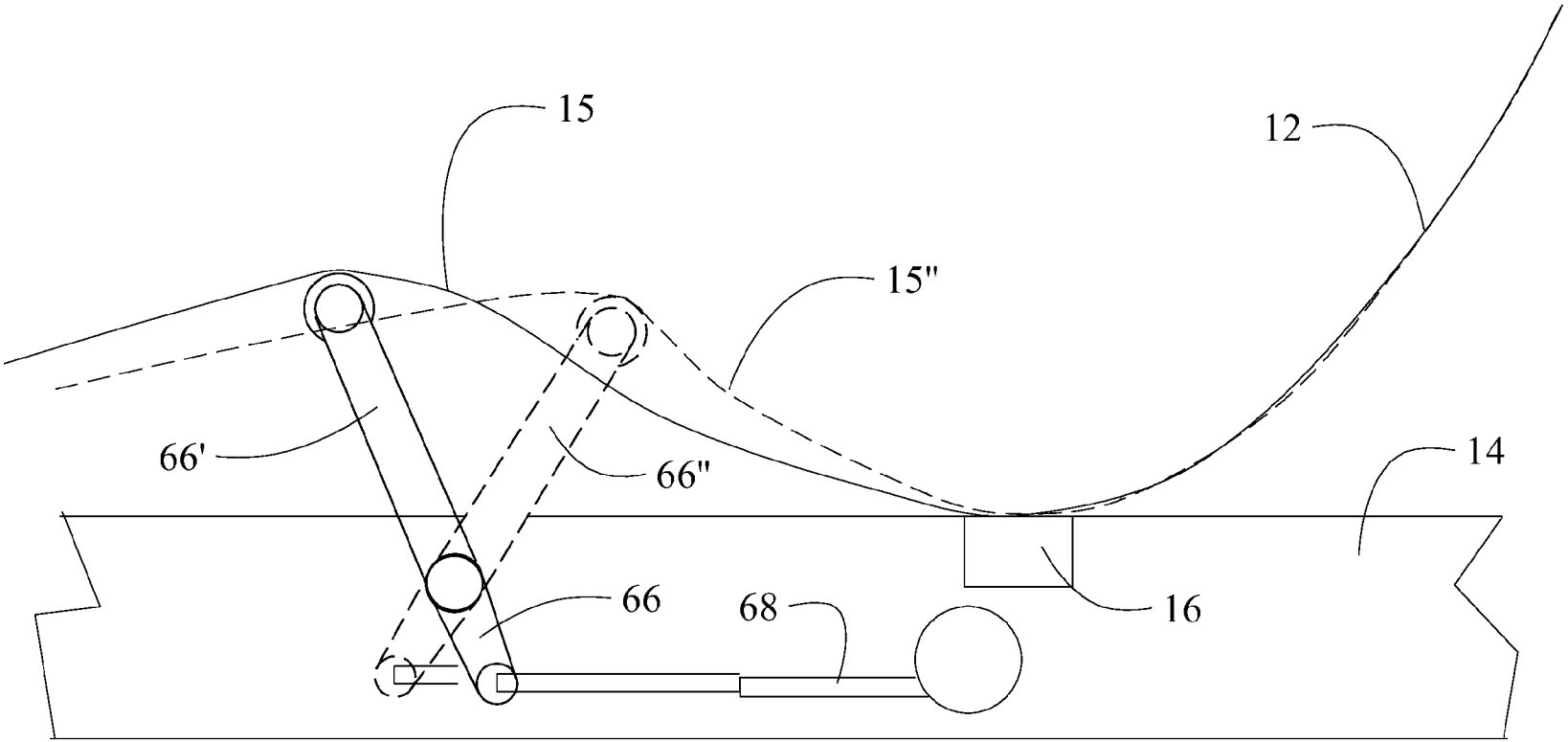
FIG. 17 is a side view of an alternative embodiment for the leg portion adjustment.

The lack of securing attachment of the flexible support member 12 to the leg portion adjustment member 24 additionally allows adjustment of the positioning of the knee bend in the flexible support member to accommodate the length of the user's thigh from hip to knee. When the articulating structure of the bed is adjusted for raising the upper body portion 13, the user naturally settles into a seated position at the curvature induced in the mattress. The length of the thigh then becomes the determining dimension desire for the knee bend location. Since this may vary significantly between tall and short users, conventional beds do not adequately provide for this variation. In the present embodiments, the longitudinal position of the leg portion adjustment member 24 may be adjusted to accommodate this length. Alternatively, a single lever actuation element 66 as shown in FIG. 17 may be employed to raise the flexible support member 12 at the knee position. Rotating the actuation element by an actuator 68 to a normal raised position 66' places the thigh portion 15 and lower leg portions in the rotated positions draped normally over the knee position. By rotating beyond the vertical to a position 66", a shortening of the knee position relative to the rigid cross member 16 is obtained thereby allowing for shorter length of the thigh portion 15". The natural height reduction created by the overcenter rotation of the actuation element 66 at position 66" further compensates for a shorter thigh length. As shown in FIG. 17, the actuation element 66 may employ a wheel 70 for engagement of the underside of the flexible support member 12.

Figure 18:
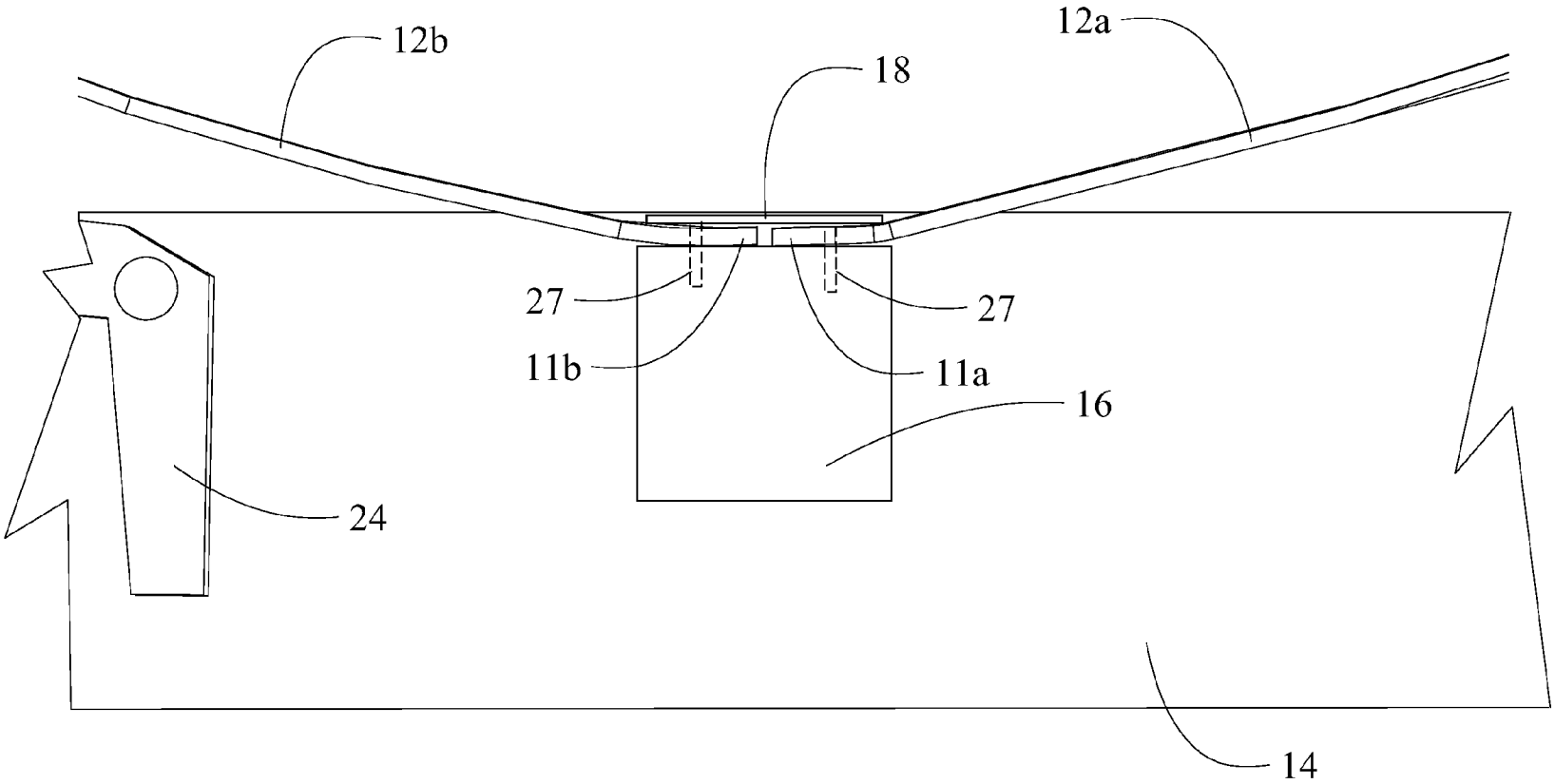
FIG. 18 is a detailed side view of an alternative embodiment with a split flexible support member and engagement structure for the cross member.

Alternative embodiments employing the flexible support member may be employed for increased utility or for operation with alternative articulation systems. As shown in FIG. 18, the flexible support member 12 of prior embodiments may be bifurcated into an upper body flex element 12*a* and a lower body flex element 12*b* to reduce the continuous length of the flex member for ease of manufacturing and shipment; providing half the continuous longitudinal dimension. The upper body flex element 12*a* and lower body flex element 12*b* are secured to the cross member 16, extending toward the head and foot of the frame 14, respectively. The plate or discs 18 secured through the flexible support member 12 in previously described embodiments, may be employed to engage mating ends 11*a* and 11*b* between the plate 18 and upper surface of the cross member 16 for frictional engagement. Alternatively, the plate 18 may employ fasteners 27 extending through the peripheral portion of the mating ends 11*a* and 11*b* into the support member 16 for additional constraining engagement. Articulation of the upper body flex element 12*a* and lower body flex element 12*b* may be accomplished in an identical manner to the single flexible support member 12 as described for the initial embodiment.

Figure 19:
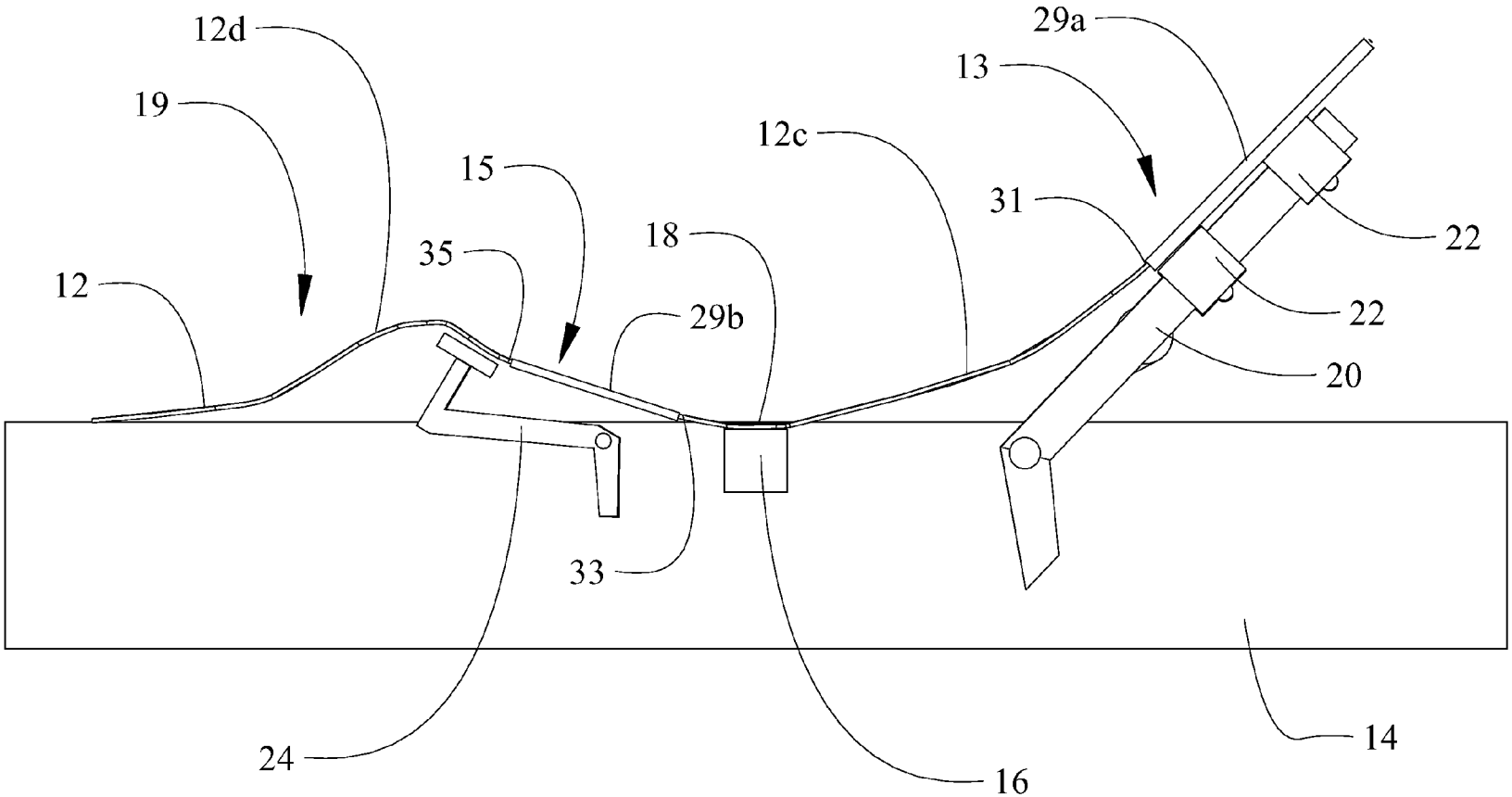
FIG. 19 is a side view of an alternative embodiment with combined flex sections and rigid sections for the mattress support member; and, FIG. 20 is a side view of an alternative articulation actuation system for the flexible support member.

The advantageous properties of the flexible support member may also be achieved using a hybrid support member having flexible portions and rigid portions as shown for an exemplary embodiment in FIG. 19. Rigid elements may be employed, for example, in regions where no significant bending of the flexible support member 12 occurs during articulation of the bed. In this exemplary embodiment, flexible support member 12 of the initial embodiment employs a central flexible portion 12*c* which is engaged at the cross member 16 as previously described. However, a rigid upper body and/or head element 29*a* is engaged to an upper peripheral edge 31 of the central flexible portion 12*c* for support of the mattress in the shoulder, neck and head region of the user. Edge 31 may be engaged by the upper body element 29*a* with fasteners or a slotted frictional engagement. For the embodiment shown, the rigid upper body element 29*a* is attached to the shuttles 22 for articulation of the combined support member, central flexible portion 12*c* and rigid upper body element 29*a*, as described for the initial embodiment for the upper body portion 13.

Similarly, a rigid thigh support element 29*b* may be engaged at a lower peripheral edge 33 on the central flexible portion 12*c* and a lower leg flexible portion 12*d* may be attached to the rigid thigh support element at an upper peripheral edge 35. As described for the rigid upper body element 29*a*, the rigid thigh support element 29*b* may engage the peripheral edges with fasteners or a slotted frictional engagement. The configuration of the rigid thigh support element 29*b* as attached to the central flexible portion 12*c* and flexible lower leg portion 12*d* allows articulation of the thigh portion 15 and lower leg portion 19 as described for the initial embodiment. For embodiments employing rigid elements, to achieve the desired flexing shape of the flexible support member to maintain engagement with the mattress without lifting of the mattress during articulation, the rigid elements extend no more than a range of 60% to 85% of overall length of the flexible support (the flexible portions providing at least 15% to 40% of overall length).

Figure 20:
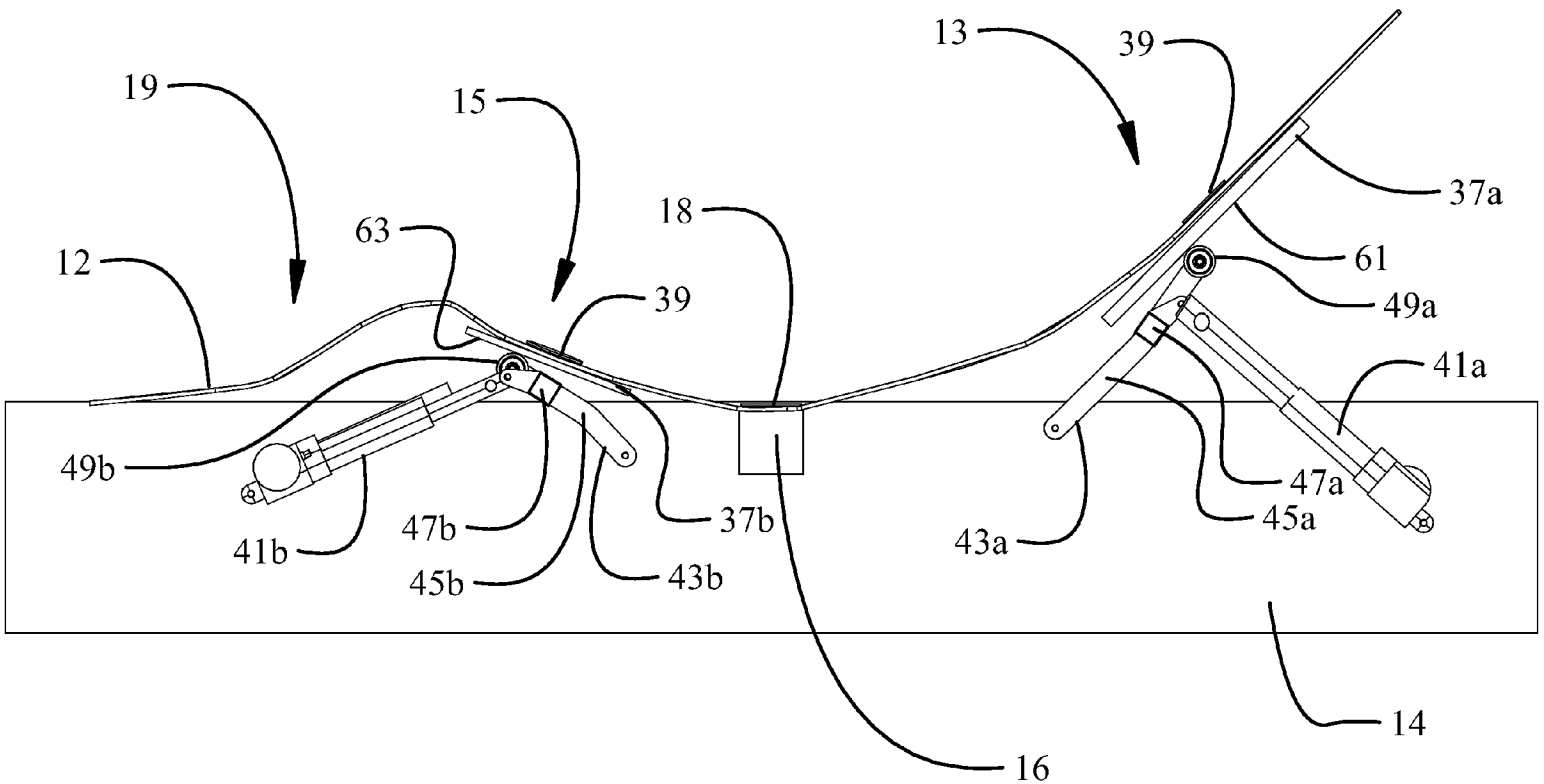

The flexible support member 12 may also be employed in alternative embodiments incorporating conventional articulating structure by providing rigid backing elements as shown in FIG. 20. An upper rigid backing element 37*a* engages the flexible support member 12 in the upper body portion 13. Attachment of the flexible support member 12 to the upper rigid backing element 37*a* may be accomplished with plates or discs 39 in a manner comparable to attachment of the flexible support member 12 to the cross member 16. Articulation of the upper body portion 13 may then be accomplished by an actuating assembly having actuator 41*a* having a first end pivotally attached to a cross member or head end rail of the frame 14 substantially at a midpoint and a second end pivotally attached to a roller assembly 43*a*. The roller assembly 43*a*, for the example embodiment, includes arms 45*a* pivotally attached at first ends to the frame 14 or cross member in the frame. Arms 45*a* are interconnected with spacer bar 47*a*. Pivotal attachment of the second end of the actuator to the roller assembly 43*a* is accomplished substantially at a midpoint of the spacer bar 47*a*. Arms 45*a* terminate in rollers 49*a* which engage a lower surface 61 of the upper rigid backing element 37*a*.

For the example embodiment, actuator 41*a* is a motor driven linear actuator having a range of motion from a retracted position with the flexible support member and upper rigid backing element 37*a* in an aligned position with the frame 14 to an extended position as shown in FIG. 20 with the upper body portion 13 fully articulated upward. Extending the actuator 44 from the retracted position urges roller assembly 43*a* to rotate about the pivotal attachments with rollers 49*a* rolling along the lower surface 61 to elevate the upper rigid backing element 37*a*.

Similarly, a lower rigid backing element 37*b* may engage the flexible support member 12 in the thigh portion 15. Attachment of the flexible support member 12 to the lower rigid backing element 37*b* may be accomplished with plates or discs 39 in a manner comparable to attachment of the flexible support member 12 to the cross member 16. Articulation of the thigh portion 13 may then be accomplished by a second actuating assembly having an actuator 41*b* having a first end pivotally attached to a cross member or foot end rail of the frame 14 substantially at a midpoint and a second end pivotally attached to a roller assembly 43*b*. The roller assembly 43*b*, for the example embodiment, includes arms 45*b* pivotally attached at first ends to the frame 14 or cross member in the frame. Arms 45*b* are interconnected with spacer bar 47*b*. Pivotal attachment of the second end of the actuator to the roller assembly 43*b* is accomplished substantially at a midpoint of the spacer bar 47*b*. Arms 45*b* terminate in rollers 49*b* which engage a lower surface 63 of the upper rigid backing element 37*b*.

As for the upper body actuator, actuator 41*b* is a motor driven linear actuator having a range of motion from a retracted position with the flexible support member and lower rigid backing element 37*b* in an aligned position with the frame 14 to an extended position as shown in FIG. 20 with the thigh portion 15 fully articulated upward. Extending the actuator 41*b* from the retracted position urges roller assembly 43*b* to rotate about the pivotal attachments with rollers 49*b* rolling along the lower surface 63 to elevate the lower rigid backing element 37*b*.

For the embodiment shown, the attachment of the flexible support member 12 to the rigid backing elements 37*a*, 37*b* with plates 39 allows the flexible support member to flex away from the rigid backing elements as required thereby maintaining a smooth curvature. In alternative embodiments in which the rigid backing elements are located along portion of the flexible support member which incur minimal flexing during articulation the flexible support member may be attached to the rigid backing elements with adhesive or fasteners over the entire surface.

The rigid elements described with respect to the embodiment of FIG. 19 may be employed for use with an actuation system as described with respect to FIG. 20 replacing the rigid backing elements.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. An articulating bed comprising:

a frame having side frame members and a rigid cross frame member extending between the side frame members;

a flexible support member secured to the rigid cross frame member, said flexible support member having an upper body portion;

a rigid upper backing element engaging a portion of the upper body portion and attached to the upper body portion with plates allowing the flexible support member to flex away from the rigid upper backing element maintaining a smooth curvature or with adhesive or fasteners over an entire surface of the rigid upper backing element wherein the portion of the upper body portion incurs minimal flexing during articulation; and, an actuating assembly engaging a lower surface of the rigid upper backing element, said actuating assembly rotatable through a range of motion from an aligned position with the side frame members to a fully elevated position angularly supporting the upper body portion in a raised position.

2. The articulating bed as defined in claim 1 further comprising:

a rigid lower backing element engaging a portion of a thigh portion of the flexible support member and attached to the thigh portion with plates allowing the flexible support member to flex away from the rigid lower backing element maintaining a smooth curvature of with adhesive or fasteners over an entire surface of the rigid lower backing element wherein the portion of the thigh portion incurs minimal flexing during articulation; and, a second actuating assembly engaging a lower surface of the rigid lower backing element, said second actuating assembly rotatable through a range of motion from an aligned position with the side frame members to a fully elevated position placing a knee position at an elevated location with angular positioning of the thigh portion and a lower leg portion.

3. The articulating bed as defined in claim 1 wherein the actuating assembly comprises:

an actuator pivotally attached at a first end to the frame, said actuator having a range of motion from a retracted position to an extended position;

a roller assembly pivotally attached to the frame and having a spacer bar, a second end of the actuator pivotally attached to a midpoint of the spacer bar, said roller assembly further having rollers engaging a lower surface of the rigid upper backing element, said rigid upper backing element substantially horizontal with the actuator in said retracted position and urged by the rollers for angular rotation about an axis through a range of motion for the actuator to a raised position in the extended position.

4. The articulating bed as defined in claim 3 wherein the roller assembly comprises first and second arms having a pivotal attachment to the frame and opposite ends of the spacer bar, said rollers located at ends of the first and second arms distal from the pivotal attachment.

5. The articulating bed as defined in claim 2 wherein the second actuating assembly comprises:

a second actuator pivotally attached at a second end to the frame, said actuator having a range of motion from a retracted position to an extended position;

a second roller assembly pivotally attached to the frame and having a second spacer bar, a second end of the second actuator pivotally attached to a midpoint of the second spacer bar, said second roller assembly further having second rollers engaging a lower surface of the rigid lower backing element, said rigid lower backing element substantially horizontal with the second actuator in said retracted position and urged by the second rollers for angular rotation about an axis through a range of motion for the actuator to a raised position in the extended position.

6. The articulating bed as defined in claim 5 wherein the second roller assembly comprises third and fourth arms having a pivotal attachment to the frame and opposite ends of the second spacer bar, said second rollers located at ends of the third and fourth arms distal from the pivotal attachment.

* * * * *